US010667577B2

(12) United States Patent
Dupre et al.

(10) Patent No.: US 10,667,577 B2
(45) Date of Patent: Jun. 2, 2020

(54) FOOTWEAR WITH SOLE STRUCTURE INCORPORATING LOBED FLUID-FILLED CHAMBER WITH PROTRUDING END WALL PORTIONS

(71) Applicant: NIKE, Inc., Beaverton, OR (US)

(72) Inventors: Risha Dupre, Tigard, OR (US); Steve M. Mathras, Portland, OR (US); Mark C. Miner, Portland, OR (US); Eric S. Schindler, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 133 days.

(21) Appl. No.: 15/622,397

(22) Filed: Jun. 14, 2017

(65) Prior Publication Data

US 2017/0273402 A1 Sep. 28, 2017

Related U.S. Application Data

(63) Continuation of application No. 14/340,374, filed on Jul. 24, 2014, now Pat. No. 9,687,044.

(51) Int. Cl.

| | |
|---|---|
| ***A43B 13/20*** | (2006.01) |
| ***A43B 13/14*** | (2006.01) |
| ***A43B 13/22*** | (2006.01) |

(52) U.S. Cl.

CPC ..... *A43B 13/20* (2013.01); *A43B 13/141* (2013.01); *A43B 13/146* (2013.01); *A43B 13/223* (2013.01)

(58) Field of Classification Search

CPC ..... A43B 13/20; A43B 13/223; A43B 13/141; A43B 13/146; A43B 13/189; A43B 13/203; A43B 13/206

(Continued)

(56) References Cited

U.S. PATENT DOCUMENTS 5,014,449 A 5/1991 Richard et al.
5,185,943 A * 2/1993 Tong ..... A43B 5/00 36/27

(Continued)

FOREIGN PATENT DOCUMENTS

CN 101547620 A 9/2009
CN 102258234 A 11/2011

OTHER PUBLICATIONS

International Searching Authority, International Search Report and Written Opinion for PCT Application No. PCT/US2015/041489, dated Oct. 15, 2015.

(Continued)

*Primary Examiner* — Heather N Mangine
(74) *Attorney, Agent, or Firm* — Honigman LLP; Matthew H. Szalach; Jonathan P. O'Brien

(57) ABSTRACT

A sole structure for an article of footwear includes a fluid-filled chamber component having a central portion, a plurality of lobes extending outward from the central portion, and a plurality of channels formed between the plurality of lobes. The structure also includes a midsole component inter-fitted with the plurality of lobes of the fluid-filled chamber component and having a plurality of projections extending through the plurality of channels of the fluid-filled chamber component. The midsole component forms a portion of the peripheral side surface of the sole structure. At least a first lobe of the plurality of lobes has an exposed distal end wall and includes a projecting portion that extends further outward from the central portion of the fluid-filled chamber component than the portion of the peripheral side surface of the sole structure formed by the midsole component. The exposed distal end wall also includes a faceted surface.

20 Claims, 10 Drawing Sheets

(58) Field of Classification Search
USPC ..... 36/28, 29, 31, 103
See application file for complete search history.

(56) References Cited

U.S. PATENT DOCUMENTS 5,337,492 A * 8/1994 Anderie ..... A43B 13/181 36/114
5,625,964 A 5/1997 Lyden et al.
5,794,359 A * 8/1998 Jenkins ..... A43B 13/206 36/28
5,901,467 A * 5/1999 Peterson ..... A43B 13/20 36/28
5,930,918 A * 8/1999 Healy ..... A43B 13/18 36/29
5,979,078 A * 11/1999 McLaughlin ..... A43B 13/203 36/29
6,009,637 A * 1/2000 Pavone ..... A43B 13/14 36/28
6,158,149 A * 12/2000 Rudy ..... A43B 7/144 36/29
6,582,786 B1 * 6/2003 Bonk ..... A43B 1/0045 428/35.7
6,962,008 B2 * 11/2005 Manz ..... A43B 13/12 36/103
7,080,467 B2 * 7/2006 Marvin ..... A43B 13/189 36/28
7,086,179 B2 * 8/2006 Dojan ..... A43B 13/20 36/28
7,353,625 B2 * 4/2008 Ellis ..... A43B 7/144 36/28
7,401,419 B2 * 7/2008 Lucas ..... A43B 1/0009 36/27
7,565,754 B1 * 7/2009 Acheson ..... A43B 13/026 36/144
7,707,744 B2 * 5/2010 Schindler ..... A43B 7/144 36/29
8,732,984 B2 * 5/2014 Ha ..... A43B 13/18 36/28
8,839,531 B2 * 9/2014 Sullivan ..... A43B 7/144 36/25 R
8,914,998 B2 * 12/2014 Gheorghian ..... A43B 5/06 36/103
9,867,427 B2 * 1/2018 Fujita ..... A43B 13/125
2002/0121031 A1 * 9/2002 Smith ..... A43B 7/141 36/29
2003/0056400 A1 * 3/2003 Potter ..... A43B 13/143 36/88
2003/0208929 A1 * 11/2003 Lucas ..... A43B 3/0063 36/28
2006/0117604 A1 * 6/2006 Fusco ..... A43B 3/00 36/25 R
2006/0137221 A1 * 6/2006 Dojan ..... A43B 13/20 36/29
2007/0119075 A1 * 5/2007 Schindler ..... A43B 7/144 36/29
2007/0220778 A1 * 9/2007 Fusco ..... A43B 7/1415 36/30 R
2009/0090025 A1 * 4/2009 Cassiday ..... A43B 13/188 36/29
2009/0178300 A1 * 7/2009 Parker ..... A43B 13/14 36/29
2010/0236096 A1 * 9/2010 Pauk ..... A43B 13/12 36/28
2010/0269376 A1 * 10/2010 Flannery ..... A43B 13/125 36/30 R
2011/0185590 A1 * 8/2011 Nishiwaki ..... A43B 5/06 36/28
2011/0197469 A1 * 8/2011 Nishiwaki ..... A43B 7/24 36/28
2011/0232130 A1 * 9/2011 Boudreau ..... A43B 13/141 36/88
2012/0102783 A1 5/2012 Swigart et al.
2012/0233885 A1 * 9/2012 Shaffer ..... A43B 13/20 36/103
2014/0150298 A1 * 6/2014 Crowley ..... A43B 7/1445 36/103
2014/0202031 A1 * 7/2014 Seo ..... A43B 13/181 36/28
2014/0259769 A1 * 9/2014 Bjornson ..... A43B 7/142 36/91
2014/0259789 A1 * 9/2014 Dojan ..... A43B 13/122 36/103
2014/0331517 A1 * 11/2014 Seo ..... A43B 7/1405 36/28
2015/0230549 A1 * 8/2015 Bernhard ..... A43B 13/181 36/25 R
2017/0020228 A1 * 1/2017 Scofield ..... A43B 13/181
2017/0095034 A1 * 4/2017 Dupre ..... A43B 13/141
2017/0150778 A1 * 6/2017 Youngs ..... A43B 7/20

OTHER PUBLICATIONS

Taiwan Intellectual Property Office, Official Letter and Search Report for Application No. 105119165, dated Mar. 3, 2017.
State Intellectual Property Office (PRC), Office Action for CN Application No. 201580046215.X, dated Mar. 30, 2018.
Taiwan Intellectual Property Office, Office Action for TW Application No. 106134938, dated Aug. 10, 2018.
State Intellectual Property Office (PRC), Second Office Action for CN Application No. 201580046215.X, dated Dec. 25, 2018.
European Patent Office, Communication pursuant to Article 94(3) EPC for Application No. 15744838.2, dated Feb. 22, 2019.
State Intellectual Property Office (PRC), Third Office Action for CN Application No. 201580046215.X, dated May 15, 2019.

* cited by examiner

FOOTWEAR WITH SOLE STRUCTURE INCORPORATING LOBED FLUID-FILLED CHAMBER WITH PROTRUDING END WALL PORTIONS

CROSS REFERENCE TO RELATED APPLICATION

This application is a Continuation of U.S. patent application Ser. No. 14/340,374, filed Jul. 24, 2014, the contents of which are hereby incorporated by reference in their entirety.

FIELD OF THE INVENTION

The present embodiments generally relate to articles of footwear, and more particularly relate to articles of footwear having a sole structure incorporating a lobed fluid-filled chamber.

BACKGROUND

Articles of footwear generally include an upper and a sole structure.

An upper generally forms a footwear body that extends over a portion of a foot to retain the article of footwear on the foot. An upper may extend over an instep and toe areas of the foot, along medial and lateral sides of the foot, and/or around a heel area of the foot. An upper may be formed from one or more material elements, such as textiles, polymer sheet layers, foam layers, leather, synthetic leather, and other materials. These materials may be attached together, such as by stitching or adhesive bonding. An upper may be configured to form an interior of the footwear that comfortably and securely receives a foot. An upper may include an opening that facilitates entry and removal of the foot from the interior of the upper, and further may include a closure system, such as lacing, cinches, or straps, that enables a wearer to adjust a fit of the article of footwear.

A sole structure generally is attached to the upper and disposed between the foot and a ground surface. For example, a sole structure may be attached to a lower portion of the upper. A sole structure may include one or more components, including one or more outsole, midsole, insole, insert, bladder or fluid-filled chamber, such as an airbag. A sole structure also may include other components or elements, such as ground surface traction elements.

An upper and sole structure may operate to provide a comfortable article of footwear structure configured to benefit a wearer engaged in any of a variety of activities. For example, a sole structure may operate to attenuate impact and ground reaction forces and/or to provide traction on a ground surface. An upper and sole structure may cooperate to control various foot motions, such as pronation.

SUMMARY

An article of footwear having a sole structure including a lobed fluid-filled chamber component and inter-fitted midsole component, such as a polymer foam material component, provides improved customization, cushioning, and flexibility performance characteristics of the sole structure and article of footwear.

In one aspect, an element of a sole structure for an article of footwear includes a fluid-filled chamber component having a central portion, a plurality of lobes extending outward from the central portion, and a plurality of channels formed between the plurality of lobes, the plurality of channels extending in a direction from a top surface of the fluid-filled chamber component to a bottom surface of the fluid-filled chamber component, at least a first channel of the plurality of channels defined by two adjacent lobes of the plurality of lobes forming a side opening of the first channel located opposite the central portion of the fluid-filled chamber component, the side opening of the first channel corresponding to a portion of a peripheral side of the sole structure, and at least a first lobe of the two adjacent lobes forming the side opening of the first channel having an exposed distal end wall that forms a portion of a peripheral side surface of the sole structure, the exposed distal end wall having a projecting portion that extends further outward from the central portion than the portion of the peripheral side of the sole structure associated with the exposed open side of the first channel.

In another aspect, a sole structure for an article of footwear includes a fluid-filled chamber component having a central portion, a plurality of lobes extending outward from the central portion, and a plurality of channels formed between the plurality of lobes, the plurality of channels extending in a direction from a top surface of the fluid-filled chamber component to a bottom surface of the fluid-filled chamber component, and a midsole component inter-fitted with the plurality of lobes of the fluid-filled chamber component, a plurality of projections of the midsole component extending through the plurality of channels of the fluid-filled chamber component, the midsole component forming a portion of a peripheral side surface of the sole structure, wherein at least a first lobe of the plurality of lobes has an exposed distal end wall including a projecting portion that extends further outward from the central portion of the fluid-filled chamber component than the portion of the peripheral side surface of the sole structure formed by the midsole component.

In some embodiments, at least one of the plurality of lobes may have a trapezoidal or triangular cross section. In some embodiments, at least one of the plurality of channels may have a generally truncated conical configuration and/or a generally trapezoidal or triangular cross section. In some embodiments, the projecting portion may be formed by a surface portion of an exposed distal end wall that is arranged at an angle. In some embodiments the projecting portion may be formed by an edge portion of a faceted surface of the exposed distal end wall. In some embodiments the projecting portion may be a generally trapezoidal edge portion.

In some embodiments, the midsole component may have an upper surface, a lower surface, and a plurality of projections that extend through and are inter-fitted with the plurality of channels of the fluid-filled chamber component in a direction from the top surface of the fluid-filled chamber component to a bottom surface of the fluid-filled chamber component, and wherein exposed side walls of the plurality of projections form the portion of the peripheral side surface of the sole structure. In some embodiments, the midsole component may include a flex structure, such as a triangular or trapezoidal wedge-shaped indentation on an exposed side wall of at least one of the plurality of projections. In some embodiments, the midsole component may include a flex structure, such as a lateral groove formed at a distal end of at least one of the plurality of projections.

In some embodiments, the sole structure further may include an outer sole component. In some embodiments, the outer sole component may include an outer flex structure, such as a groove or cut-out portion, that may be aligned in registration with a flex structure of the midsole component.

In another aspect, an article of footwear includes an upper and a sole structure associated with the upper. The sole structure includes at least one fluid-filled chamber component having a central portion, a plurality of lobes extending outward from the central portion, and a plurality of channels formed between the plurality of lobes, the plurality of channels extending in a direction from a top surface of the fluid-filled chamber component to a bottom surface of the fluid-filled chamber component, and a midsole component inter-fitted with the plurality of lobes of the fluid-filled chamber component, a plurality of projections of the midsole component extending through the plurality of channels of the fluid-filled chamber component, the midsole component forming a portion of a peripheral side surface of the sole structure, wherein at least a first lobe of the plurality of lobes has an exposed distal end wall including a projecting portion that extends further outward from the central portion of the fluid-filled chamber component than the portion of the peripheral side surface of the sole structure formed by the midsole component.

In some embodiments, the protruding portion of the exposed distal end wall of at least the first lobe may be formed by at least one facet of the exposed distal end wall. The at least one facet may be disposed at an angle relative to the peripheral side surface of the exposed side wall of the first projection. The peripheral side surface formed by the exposed side wall may have a generally vertical configuration.

In some embodiments, at least one projection of the plurality of projections of the midsole component may have an exposed side wall that forms a portion of the peripheral side surface of the sole structure between exposed end walls of two adjacent lobes. The exposed side wall of the at least one projection may be provided with flex structure, such as a generally concave indentation or a plurality of recesses, e.g., arranged in a recess pattern. A size, shape, and configuration of the flex structure may be selected to structurally and/or visually complement the protruding portion of at least one of the two adjacent lobes of the fluid-filled chamber component. This configuration may facilitate compressibility, bending, and flexing of the sole structure at a location between the two adjacent lobes of the fluid-filled chamber, as well as provide the sole structure and article of footwear with a side profile that is aesthetically pleasing, such as a "zig-zag" profile. Inter-fitted portions of the sole structure may be configured to compress in a controlled manner when impact or ground reaction forces are applied to the at least one fluid-filled chamber component, or when the sole structure is flexed or bent at a flex structure of the sole structure, such that compression forces are distributed in a controlled manner within the central portion and the plurality of lobes of the fluid-filled chamber component by fluid within the fluid-filled chamber component, e.g., causing one or more protruding portion(s) of the plurality of lobes to distend. In this manner inter-fitted components of the sole structure may provide improved performance characteristics, including a smooth response characteristic, in the article of footwear. This inter-fitted construction enables customization of compressibility of the sole structure by allowing certain predetermined portions of the sole structure to expand and other portions of the sole structure to compress, as desired, while providing improved flexibility and support in the sole structure.

In some embodiments, an optional outer sole component may include at least one outer flex structure, such as a flex groove or a slot or opening in the outer sole component. At least one projection of the inter-fitted construction may include a bottom surface of the midsole component that may be exposed through a slot or opening in the outer sole and configured with a flex structure to facilitate localized compression, bending, and flexibility of the sole structure at the projection. In some embodiments, a projection of the inter-fitted construction may include at least one flex structure, such as a flex groove formed in an exposed bottom or lower surface of the midsole component, that is configured to facilitate bending and flexibility of the sole structure.

Each of the above aspects, embodiments, and features may improve at least one performance characteristic of a sole structure of an article of footwear. In particular, these aspects and features, alone and/or in combination, variously may facilitate a smooth response characteristic in a sole structure of an article of footwear, where bending of the sole structure, particularly bending of a midsole of the sole structure, occurs smoothly and without buckling. Further, these aspects, embodiments, and features variously may be combined with one another and/or with other aspects, embodiments, and features to improve overall performance of a sole structure of an article of footwear.

Other systems, methods, aspects, features, and advantages of embodiments will be, or will become, apparent to one of ordinary skill in the art upon examination of the following figures and detailed description. It is intended that all such additional systems, methods, aspects, features, and advantages be included within this description and this summary, be within the scope of the embodiments, and be protected by the following claims.

BRIEF DESCRIPTION OF THE DRAWINGS

Embodiments may be better understood with reference to the following drawings and detailed description. Elements, components, and features of the embodiments in the figures are not necessarily drawn to scale, emphasis instead being placed upon illustrating principles of the embodiments disclosed. In the figures, like reference numerals designate like or corresponding parts or features throughout the different views, with the initial digit(s) of each reference numeral indicating a figure in which the reference numeral first appears.

DETAILED DESCRIPTION

Figure 1:
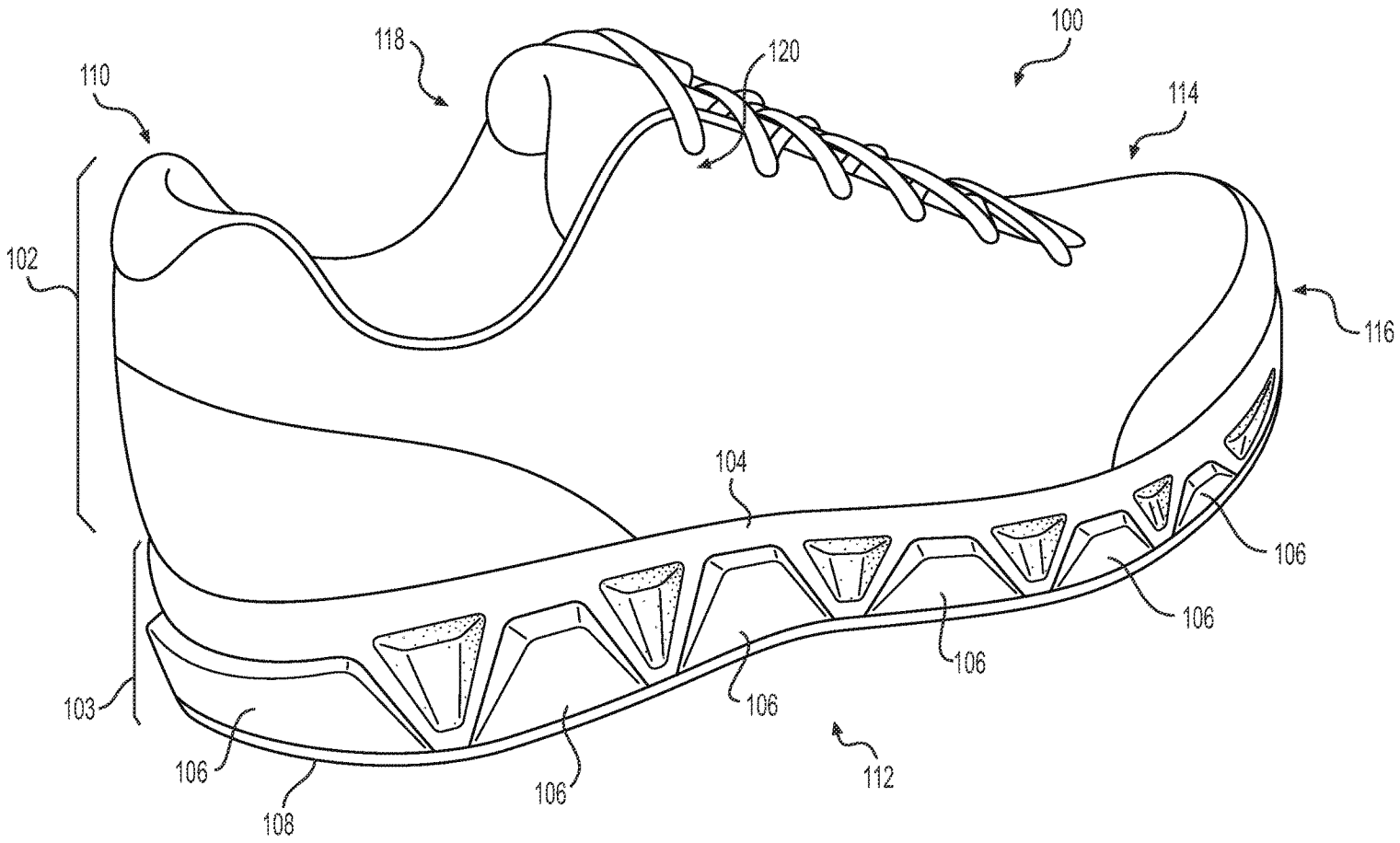
FIG. 1 is a perspective view of an embodiment of an article of footwear including a sole structure having a midsole component, a fluid-filled chamber component, and an outsole component having an inter-fitted configuration.

The following description and accompanying figures disclose embodiments of articles of footwear incorporating fluid-filled chamber components. Features and concepts related to the footwear, and more particularly to the fluid-filled chamber components and sole structure, are disclosed with reference to athletic footwear having a configuration that is suitable for running. The embodiments are not limited to athletic footwear configured for running, however, and may be applied to a wide range of footwear styles. For example, features and concepts of the embodiments may be applied to other athletic footwear, including basketball shoes, cross-training shoes, walking shoes, tennis shoes, soccer shoes, hiking boots, and other athletic footwear. Features and concepts of the embodiments also may be applied to non-athletic footwear styles, including dress shoes, loafers, sandals, work boots, and other non-athletic footwear. One skilled in the relevant art will appreciate that features and concepts of the disclosed embodiments may apply to a wide variety of footwear styles, in addition to the specific styles discussed in the following material and depicted in the accompanying figures.

Sole structures according to embodiments described herein may provide certain desirable improvements in one or more performance characteristics of athletic footwear or other articles of footwear. One such performance characteristic is known in the art as a "smooth response" characteristic, meaning that bending of the sole structure, particularly bending of a midsole component of the sole structure, occurs smoothly and without buckling. Embodiments described herein variously may facilitate or improve compressibility, bending, and flexibility of certain elements of a sole component and a sole structure as a whole. Embodiments described herein may facilitate efficient manufacture of sole structures and articles of footwear. And embodiments described herein may provide an esthetically pleasing footwear design.

A sole structure including a midsole component formed of foam material, such as a polymer foam material having a plurality of open or closed cells, may provide cushioning and attenuate impact and ground reaction forces and other forces under a load. A polymer foam material component may be configured to provide a comfortable fit, e.g., by conforming to various contours of the foot.

A sole structure including a fluid-filled chamber component may provide cushioning and attenuate impact and other ground reaction forces and other forces under a load. A fluid-filled chamber component may be formed from a polymer material that is sealed to enclose a fluid. Manufacturing techniques for making a fluid-filled chamber component suitable for footwear applications may include a two-film technique, a thermoforming technique, or a blow-molding technique.

A fluid-filled chamber component may be combined with a foam material component to form a component of a sole structure. For example, in some embodiments a fluid-filled chamber component may be located above a polymer foam material component, a fluid-filled chamber component may be located below a polymer foam material component, and/or a fluid-filled chamber component may be encapsulated within a polymer foam material component. A fluid-filled chamber component combined with a polymer foam material component may decrease a rate and/or effect of deterioration of the polymer foam material component of the sole structure caused by repeated compression of the polymer foam material by impact or other ground reaction forces during use of the article of footwear.

A fluid-filled chamber component may be combined with other midsole components to provide improved attenuation response to impact and ground reaction forces, to provide a range of customization in a sole structure, and/or to provide a pleasing aesthetic appearance of the sole structure and article of footwear.

FIG. 1 illustrates an embodiment of an article of footwear 100 that includes an upper 102 and a sole structure 103. As shown in FIG. 1, in some embodiments sole structure 103 may include a midsole component 104, a fluid-filled chamber component 106, and an optional outer sole component 108.

Upper 102 may have any configuration suitable for a desired article of footwear. Upper 102 may include one or more material element, such as textiles, foam materials, and leather materials that may be stitched or adhesively bonded together. The one or more material element may be manipulated or configured to form an interior of upper 102 for securely and comfortably receiving a foot.

Sole structure 103 may include plural components. In some embodiments sole structure 103 generally may include a midsole component 104, a fluid-filled chamber component 106, and an optional outer sole 108. Sole structure 103 may be secured to a lower surface of upper 102, such as by stitching or adhesive bonding. Fluid-filled chamber component 106 may be attached to midsole component 104, such as by adhesive bonding. And outer sole 108 may be secured to midsole component 104 and/or fluid-filled chamber component 106, such as by adhesive bonding. Sole structure 103 further may include an optional insole or inner sole (not shown), which may be a thin cushioning member typically located within the interior of upper 102 and adjacent to the foot to enhance the comfort of article of footwear 100. Those skilled in the art will appreciate alternative materials for, and methods suitable for attaching, upper 102, midsole component 104, fluid-filled chamber component 106, and optional outer sole 108 consistent with descriptions of embodiments herein.

Sole structure 103 generally operates to attenuate impact and other ground reaction forces and absorb energy, e.g., as sole structure 103 contacts a ground surface during active use.

As shown in FIG. 1, in some embodiments midsole component 104 may be located adjacent a foot when the foot is disposed in an interior of the upper 102. In some embodiments, midsole component 104 generally may be configured to conform to contours of the foot, and to provide the foot with cushioning during walking, running, or other activities. In some embodiments, midsole component 104 may be made of a foam material having an open or closed cell foam material construction. In some embodiments, midsole component 104 may be formed of a polymer foam material, such as polyurethane or ethylvinylacetate. In some embodiments, midsole component 104 may be made by any manufacturing method suitable for making a foam material component. For example, in some embodiments midsole component 104 may be made by injection molding a polymer foam material.

As shown in FIG. 1, in some embodiments fluid-filled chamber component 106 generally may be disposed between midsole component 104 and optional outer sole component 108. Fluid-filled chamber component 106 may be made of any material suitable for holding a desired fluid in a sole construction. In some embodiments, fluid-filled chamber component 106 may be made of a polymer material that is substantially impermeable to fluid within a closed chamber of fluid-filled chamber component 106. In some embodiments, fluid-filled chamber component 106 may be made of a thermoplastic elastomer.

Fluid-filled chamber component 106 may be manufactured using a variety of techniques. For example, in some embodiments fluid-filled chamber component 106 may be made by blow molding, thermoforming, rotational molding, or other molding processes.

As shown in FIG. 1, in some embodiments midsole component 104 may be inter-fitted with fluid-filled chamber component 106 in a manner that presents a sole structure 103 and article of footwear 100 having an aesthetically pleasing side profile. As shown in FIG. 1, in some embodiments midsole component 104 may be inter-fitted with fluid-filled chamber component 106 in a manner that presents a sole structure 103 and article of footwear 100 having a generally "zigzag" pattern side profile.

As shown in FIG. 1, optional outer sole component 108 generally may be configured to engage a ground surface and impart traction to article of footwear 100. In some embodiments, outer sole component 108 may be formed of a durable, wear-resistant material that is configured to engage a ground surface and impart traction. In some embodiments, outer sole component 108 may include at least one traction element configured to engage a ground surface and impart traction.

Hensley et al., U.S. Pat. No. 7,128,796, issued Oct. 31, 2006, and entitled "FOOTWEAR WITH A SOLE STRUCTURE INCORPORATING A LOBED FLUID-FILLED CHAMBER," the entirety of which is hereby incorporated herein by reference, discloses general aspects, features, and techniques of construction and manufacture of various components and elements of a sole structure that may be included in some aspects of some embodiments of the present disclosure. Those skilled in the art will be able to select suitable materials and techniques for making embodiments described herein in view of these descriptions and disclosures.

Referring to FIG. 1, article of footwear 100 generally includes a heel region 110, a mid-foot region 112, and a forefoot region 114 including a toe region 116. Article of footwear 100 further may include a medial side 118 and a lateral side 120. In this disclosure, references to heel region 110, mid-foot region 112, forefoot region 114, toe region 116, medial side 118, and lateral side 120 do not refer to exact structures or boundaries, but rather generally designate regions or areas of article of footwear 100. In some aspects, these regions or areas may overlap. It will be appreciated that references to heel region 110, mid-foot region 112, forefoot region 114, toe region 116, medial side 118, and lateral side 120 also may apply to various elements or components of article of footwear 100, such as upper 102, sole structure 103, midsole component 104, fluid-filled chamber component 106, and optional outer sole component 108. Further, the term lateral may be used to describe a medial-lateral direction or orientation of article of footwear 100 or a component or portion of article of footwear 100. Similarly, the terms rear or proximal and the terms front, forward, or distal may be used to describe a direction, orientation, or relative location along a direction from heel region 110 to toe region 120 of article of footwear 100 or a component or portion of article of footwear 100. Similarly, the term vertical may be used to describe a direction perpendicular to a ground surface when article of footwear 100 is disposed with its sole structure 103 laying substantially flat on the ground surface. Those skilled in the art will be able to interpret these references and relative terms throughout the disclosure and claims based on the context in which these references and terms are used in the disclosure and claims.

Figure 2:
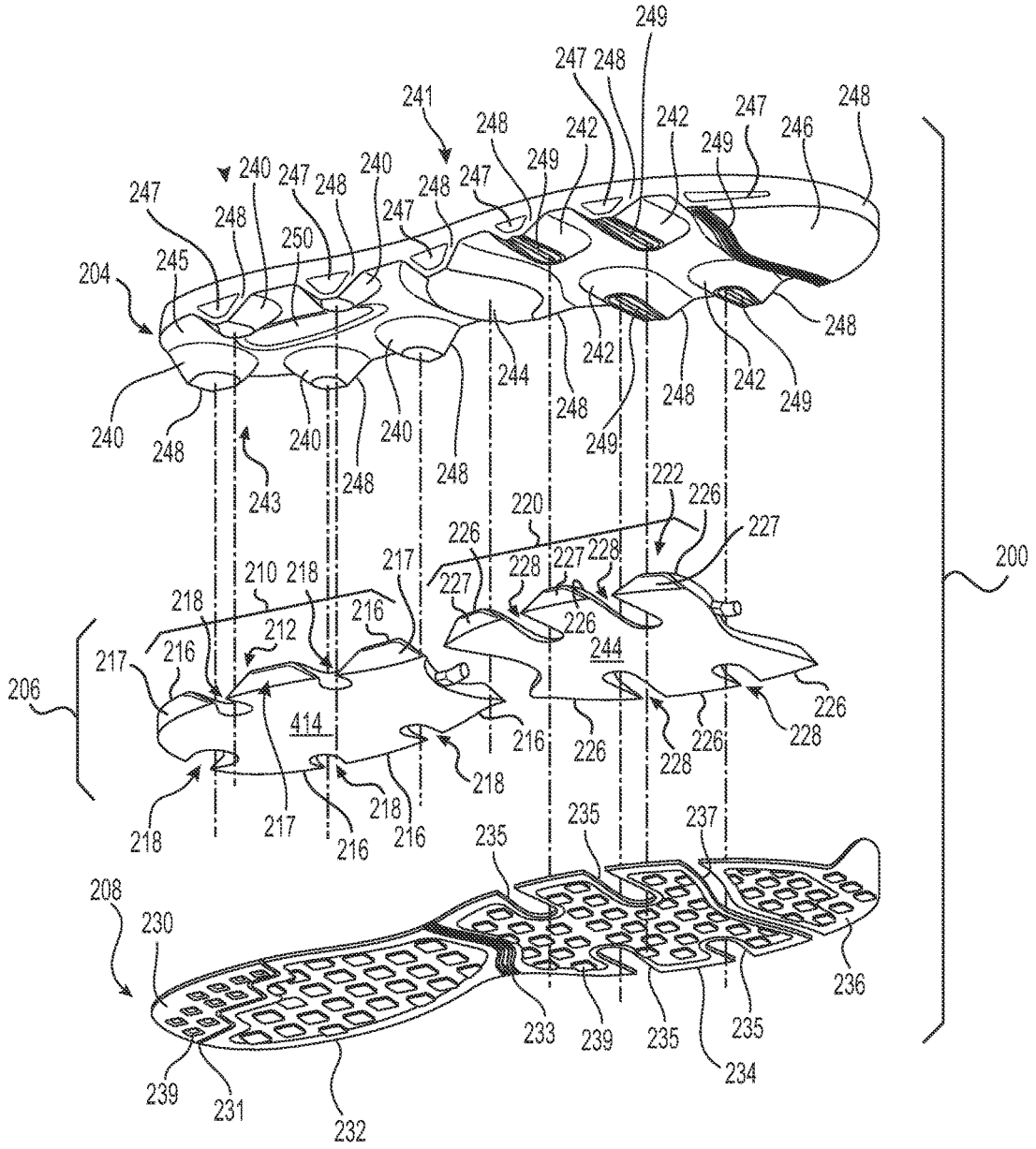
FIG. 2 is an exploded perspective view of an embodiment of a sole structure including a midsole component, a fluid-filled chamber component, and an outer sole component having an inter-fitted configuration, as viewed from a bottom and lateral side.
Figure 3:
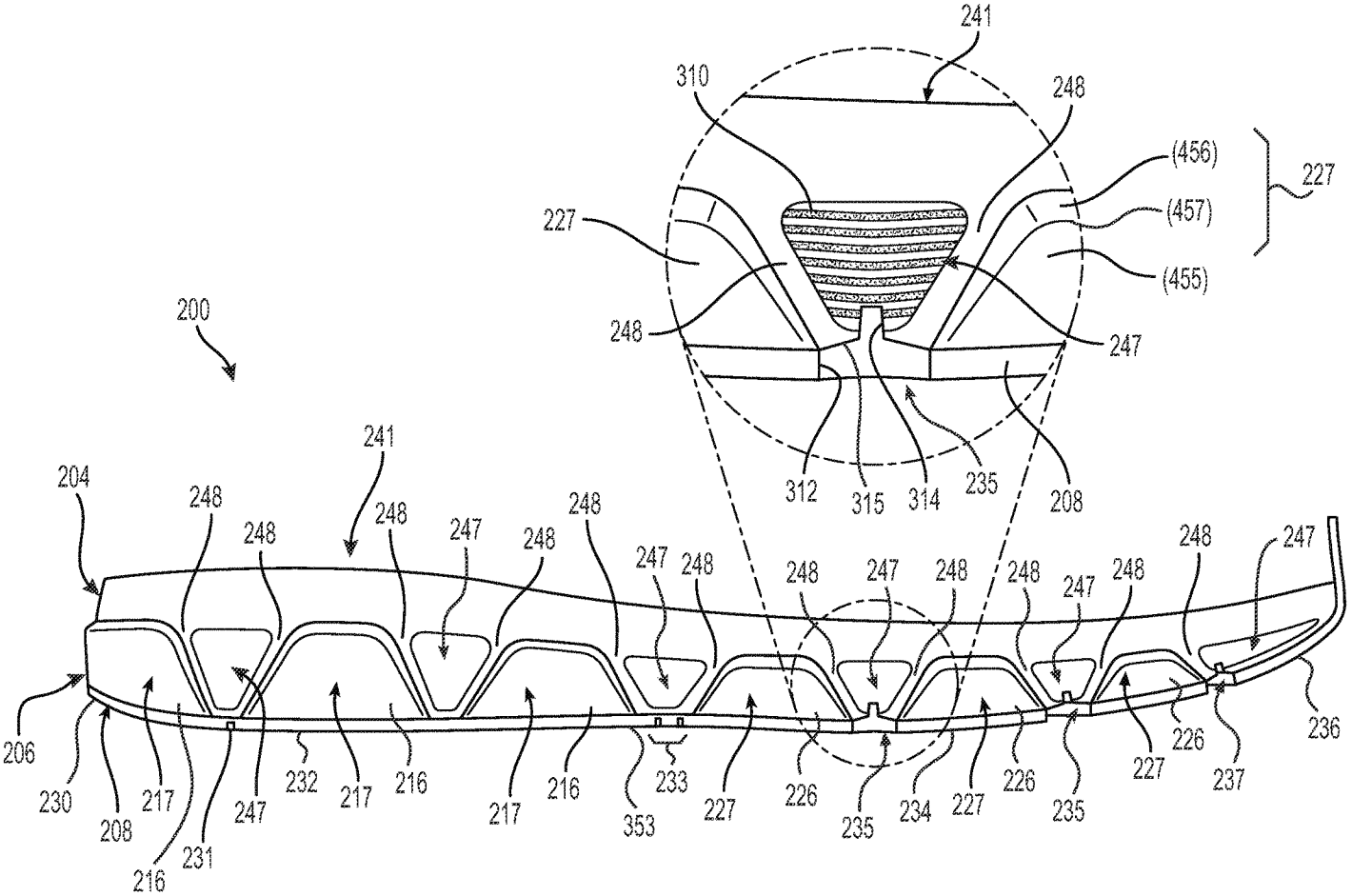
FIG. 3 is a side elevation view of an embodiment of an assembled sole structure of FIG. 2, with an enlarged partial view showing details of a portion of a midsole component inter-fitted with a fluid-filled chamber component and an outsole component.

FIGS. 2 and 3 illustrate an embodiment of a sole structure 200. FIG. 2 is an exploded view of sole structure 200, viewed from a bottom and lateral side of the sole structure 200. FIG. 3 is a lateral side profile view of assembled sole structure 200, and includes an enlarged partial view showing details of a portion of inter-fitted components and/or elements of sole structure 200. In some embodiments, sole structure 200 may correspond to sole structure 103 in FIG. 1.

As shown in FIG. 2, in some embodiments sole structure 200 may include a midsole component 204, a fluid-filled chamber component 206, and an optional outer sole component 208. In some embodiments, as discussed below, midsole component 204, fluid-filled chamber component 206, and optional outer sole component 208 may be configured to be inter-fitting to achieve an assembled sole structure 200, as shown in FIGS. 2 and 3. In some embodiments, midsole component 204, fluid-filled chamber component 206, and optional outer sole component 208 may be inter-fitted in manufacture to form assembled sole structure 200. For example, in some embodiments fluid-filled chamber component 206 and optional outer sole component 208 may be manufactured separately and layed up in a mold cavity of a molding system for molding a sole structure, and inter-fitted midsole component 204 may be formed by injection molding a molding material, such as a polymer foam material, into the mold cavity of the molding system, including the layed up sole component(s), to achieve a sole structure 200 having an inter-fitted configuration. In some embodiments, midsole component 204, fluid-filled chamber component 206, and optional outer sole component 208 may be manufactured separately, such as by various molding processes using separate molding systems and mold materials, and then bonded together in an inter-fitted configuration to form an assembled sole structure 200.

Midsole component 204 includes at least one midsole component or element. As shown in FIG. 2, in some embodiments midsole component 204 may be a single midsole component or element. In some embodiments, midsole component 204 may be formed of a foam material, such as a polymer foam material having an open or closed cell foam structure. The foam material may beneficially compresses resiliently under an applied load. In some embodiments, midsole component 204 may be formed of a material that is mold compatible or otherwise suitable for bonding with fluid-filled chamber component 206 and/or optional outer sole component 208, such as by adhesive or thermal bonding. As further discussed below, midsole component 204 may include a plurality of projections, such as projections 240, 242, 244, and 246, that may be inserted through and inter-fitted with structures of fluid-filled chamber component 206 and/or outer sole component 208. In some embodiments, at least some of plurality of projections 240, 242, 244, and 246 may be provided with exposed side walls 248 having flex structures 247 for facilitating localized compression, bending, or flexing of sole structure 200 and article of footwear 100. In some embodiments, flex structures 247 may have a concave surface and have a plurality of generally horizontal grooves 310 that may provide a desired compressibility and/or flexibility of midsole component 204 at flex structure 247.

In some embodiments, at least some of plurality of projections 240, 242, 244, 246 may be provided with flex structures 249 at distal ends of the projections for facilitating localized compression, bending, and flexing of sole structure 200 and article of footwear 100. In some embodiments, flex structures 249 may include a flex groove or sipe that may provide a desired compression or flexibility of midsole 204 at flex structure 249.

Fluid-filled chamber component 206 may include one or more fluid-filled chambers components or elements. In some embodiments, multiple fluid-filled chamber components or elements having different characteristics, e.g., having different sizes, configurations, volumes, fluids, pressures, or other compression or performance characteristics, may be provided in respective impact zones of an article of footwear. Such a configuration may enable customization of compression characteristics of the fluid-filled chamber component elements and associated performance characteristics of sole structure 200 and article of footwear 100.

As shown in FIG. 2, for example, in some embodiments fluid filled chamber component 206 may include a first fluid-filled chamber component or element 210 located in heel region 110 of sole structure 200 (hereafter also referred to as heel chamber 210) and a second fluid-filled chamber component or element 220 located in forefoot region 114 of sole structure 200 (hereafter also referred to as forefoot chamber 220). Heel chamber 210 may be configured to provide inflation and performance characteristics suitable for attenuating impact and ground reaction forces associated with a heel region of article of footwear 100, such as a heel strike portion of a running stride. Forefoot chamber 220 may be configured to provide inflation and performance characteristics suitable for stabilizing reaction forces, such as forces associated with pronation or forces associated with changing lateral directions during a running stride. Those skilled in the art will be able to select a number, configuration, and arrangement of fluid-filled chamber component (s) suitable for desired performance characteristics of a sole structure in view of the present disclosure.

Outer sole component 208 may include one or more outer sole components or elements. As shown in FIG. 2, in some embodiments outer sole component 208 may include a first outer sole component or element 230 located in heel region 110 of sole structure 200, a second outer sole component or element 232 generally located in heel region 110 and midfoot region 112 of sole structure 200, a third outer sole component or element 234 generally located in midfoot region 112 and forefoot region 114 of sole structure 200, and a fourth outer sole component or element 236 generally located in toe region 116 of sole structure 200. In some embodiments, outer sole components or elements 230, 232, 234, and 236 may be separate elements. In some embodiments, two or more of outer sole components or elements 230, 232, 234, and 236 variously may be connected to one another, e.g., integrally molded together as a single piece. For example, as shown in FIG. 2, in some embodiments outer sole component or element 230 and outer sole component or element 232 may be connected at flex groove 231, with outer sole component or element 230 being generally disposed in a heel strike area of heel region 230; in some embodiments outer sole component or element 232 and outer sole component or element 234 may be connected at flex groove 233. In some embodiments, other outer sole components or elements may have different configurations, shapes, or sizes. In some embodiments, one or more of outer sole components or elements 230, 232, 234, and 236 may be optional. In some embodiments, outer sole component 208 may be optional.

Outer sole component 208 generally may be disposed below midsole component 204 and fluid-filled chamber component 206, and may be formed of an abrasion resistant material suitable for contact with a ground surface. For example, outer sole component 208 may be disposed below midsole component 204 and fluid-filled chamber component 206 in heel region 110 to protect these components from abrasive contact with a ground surface in heel region 110, e.g., during a heel strike of a running stride. Similarly, outer sole component 208 may be disposed below midsole component 204 and/or fluid-filled chamber component 206 in forefoot region 114, e.g., below the metatarsals or balls of the foot, to protect these components from abrasive contact with a ground surface, e.g., during a pivot motion.

In some embodiments, outer sole component 208 may include one or more outer flex structures that may cooperate with one or more flex structures of inter-fitted midsole component 204 and/or fluid-filled chamber component 206 to facilitate localized compression, bending, and flexing of sole structure 200. For example, outer sole component 208 may include one or more groove portions 231, 233 in heel region 110 and/or midfoot region 112, respectively, to facilitate localized compression, bending or flexing of sole structure 200 in heel region 110 and/or midfoot region 112. Similarly, in some embodiments outer sole component 208 may include one or more cut-out portions, such as cut-out portions 235, 237 located in forefoot region 114, to facilitate localized compression, bending or flexing of sole structure 200 in forefoot region 114. For example, in some embodiments one or more pairs of cut-out portions 235 may be provided on opposing medial and lateral sides of outer sole 208, with a connecting portion of outer sole 208 disposed between the cut-out portions. In some embodiments, a cut-out portion may be provided from a medial to lateral side of outer sole 208, such as cut-out portion 237, thereby defining two or more separate outer sole components or elements. In some embodiments, outer sole 208 may include one or more traction elements 239 for providing traction with a ground surface or other external surface (e.g., a soccer ball).

Fluid-Filled Chamber Component Features

As discussed above, fluid-filled chamber component 206 may include one or more fluid filled chamber components or elements. For example, as shown in FIG. 2, in some embodiments fluid-filled chamber component 206 may include a heel chamber 210 and a forefoot chamber 220.

Heel Chamber Features

Figure 4:
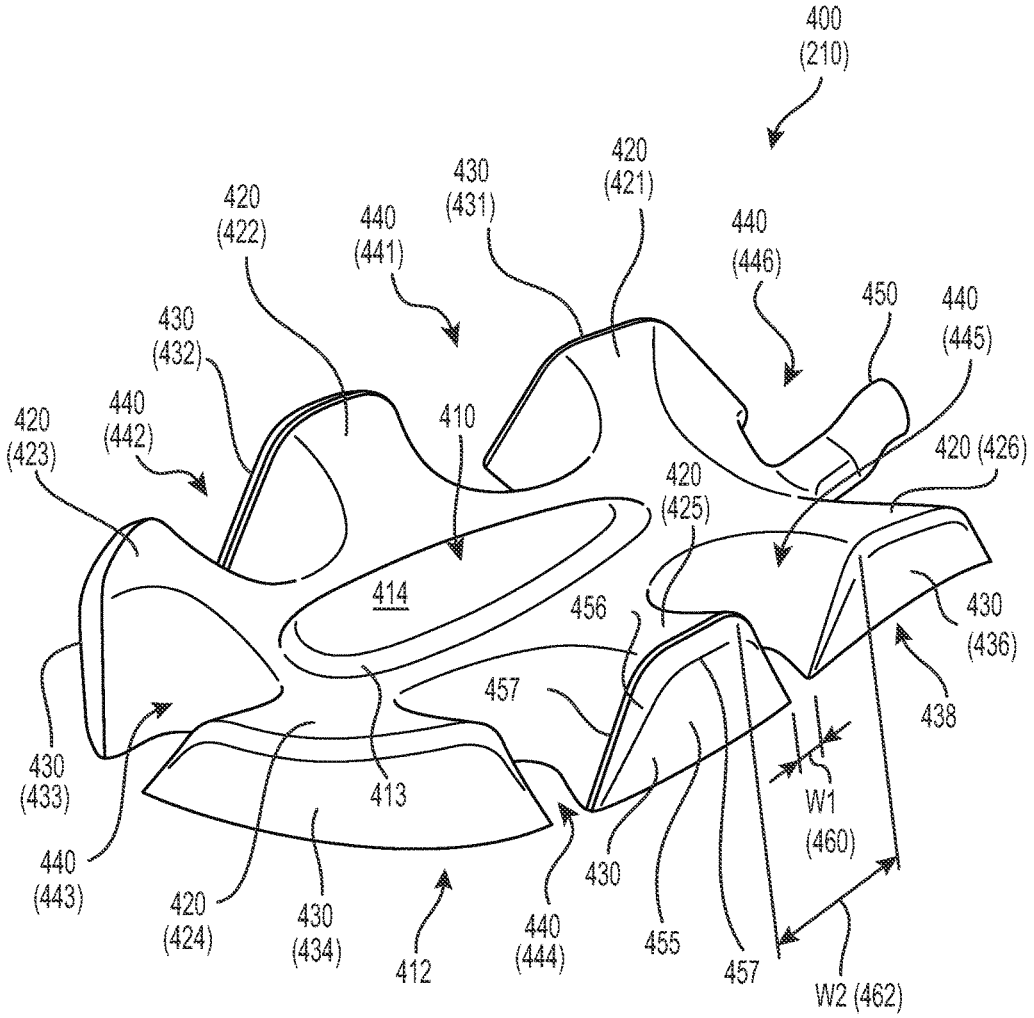
FIG. 4 is a perspective view of an embodiment of a fluid-filled chamber component located in a heel region of a sole structure of FIG. 2.
Figure 5:
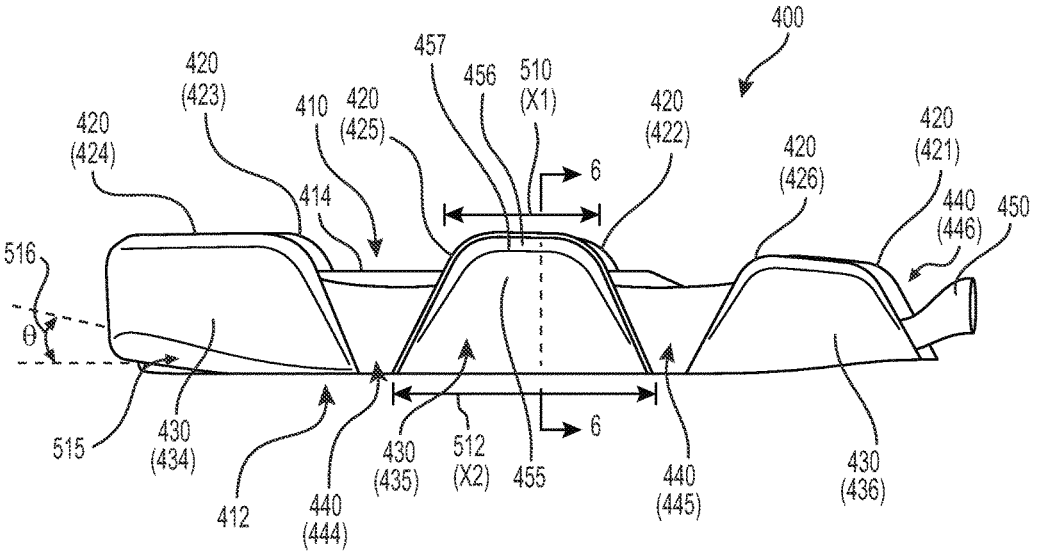
FIG. 5 is side elevation view of the fluid-filled chamber component of FIG. 4.
Figure 6:
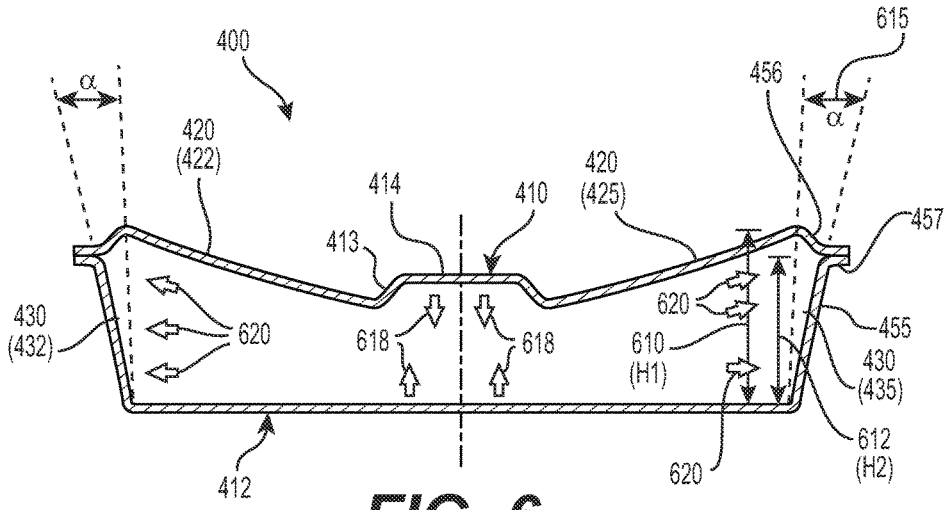
FIG. 6 is a cross-sectional view of the fluid-filled chamber component of FIG. 5, taken along section line 6-6 of FIG. 5.

FIGS. 4, 5, and 6 illustrate embodiments of a fluid-filled chamber component or element 400 suitable for use as heel chamber of a sole structure. FIG. 4 is a perspective view of fluid-filled chamber 400. FIG. 5 is a side elevation view of fluid-filled chamber component 400. And FIG. 6 is a cross-sectional view of fluid-filled chamber component 400, taken along section line 6-6 of FIG. 5. In some embodiments, fluid-filled chamber component 400 may correspond to heel chamber 210 of sole structure 200 in FIG. 2. Accordingly, elements of fluid-filled chamber component 400 may be indicated by reference numbers of corresponding elements for heel chamber 210 of sole structure 200 in FIG. 2 to describe certain features of fluid-filled chamber component 400.

As shown in FIG. 4, in some embodiments fluid-filled chamber component 400 (e.g., heel chamber 210) may be a single chamber bladder construction that includes a central portion 414 and a plurality of lobes 420 (421, 422, 423, 424, 425, 426) that extend outward from central portion 414. In some embodiments, plurality of lobes 420 may extend in selected directions around a heel region 110 of sole structure 200 and article of footwear 100. In some embodiments, fluid-filled chamber component 400 may include a plurality of channels 440 (441, 442, 443, 444, 445, 446), each generally defined on three sides by central portion 414 and respective pairs of adjacent lobes of plurality of lobes 420. As shown in FIG. 4, and as further discussed below, each of plurality of channels 440 may be open at a side opposite central portion 414 (e.g., each channel 420 may have a side opening opposite the central portion 414 of fluid-filled chamber portion 400). As discussed further below, this configuration may facilitate inter-fitting midsole component 204 with fluid-filled chamber component 400. This configuration also may enable midsole component 204 to form a portion of a peripheral side surface of sole structure 200 at side openings of plurality of channels 420. In some embodiments, a configuration of midsole component 204 with heel chamber 210 (400) may selected to provide a desired ratio of fluid to foam in specific areas under the heel portion.

Fluid-filled chamber component 400 includes a top or upper surface 410 and a bottom or lower surface 412. As shown in FIG. 4, in some embodiments top surface 410 may have a generally concave configuration. In some embodiments, top surface 410 may include a raised central portion 414. In some embodiments, central portion 414 may be defined by an angled perimeter portion 413. In some embodiments, angled perimeter portion 413 and raised central portion 414 may have a configuration, including at least size and shape, that generally conforms to a configuration of central portion 110. In some embodiments, raised portion 414 may have a regular or non-regular geometric shape, such as a circle, an oval, a rectangle, a hexagonal, or other regular or non-regular geometric shape. This configuration, including a raised central portion 414, may provide a deeper cushion, which may help provide improved cushioning of impact forces, e.g., heel strike forces, and/or lateral stability of fluid-filled chamber component 400, e.g., distribution of internal pressure forces in fluid-filled chamber component 400. In some embodiments, providing fluid-filled chamber component 400 with a raised central portion 414 having a selected regular or non-regular geometric shape may facilitate assembly of sole structure 200 including fluid-filled chamber component 400 and another component of sole structure 200 having a mating surface geometry, such as midsole component 204 of sole structure 200.

Bottom surface 412 may present a generally flat or planar surface to facilitate manufacture and assembly. For example, in some embodiments a bottom surface 412 having a generally flat or planar surface may facilitate secure attachment of fluid-filled chamber component 400 to outer sole component 208, e.g., by adhesive or thermal bonding.

Fluid-filled chamber component 400 may include a fill tube 450 in fluid communication with an interior of fluid-filled chamber component 400. In some embodiments, fill tube 450 may be sealed during manufacture of fluid-filled chamber component 400. In some embodiments, fill tube 450 may be used to charge the interior of fluid-filled chamber component 400 with desired fluid at a desired pressure during and/or after manufacture of fluid-filled chamber component 400.

A number and configuration of plurality of lobes 420 may vary based on various factors including, but not limited to, desired cushioning and performance characteristics of heel chamber 210 and sole structure 200. As shown in FIG. 4, in some embodiments fluid-filled chamber component 400 may have six lobes 420, including three lobes (421, 422, 423) generally located on a medial side of heel chamber 210, and three lobes (424, 425, 426) generally located on a lateral side of heel chamber 210. In this configuration, two lobes 423 and 424 may be located in a rear heel region of sole structure 200. This number and general configuration may provide desired cushioning, balance, stability, and/or other performance characteristics for fluid-filled chamber component 400. In some embodiments, plurality of lobes 420 may extend from central portion 414 in different selected directions to achieve desired cushioning, balance, stability, and/or performance characteristics. A number and configuration of plurality of lobes 420 also may be selected to provide a pleasing aesthetic profile, as discussed herein. Those skilled in the art will be able to select a desired number and configuration of lobes 420 suitable for achieving a sole structure and article of footwear having desired performance and aesthetic characteristics based on the present disclosure.

At least some of plurality of lobes 420 may include a distal end wall 430 that is configured to be exposed at a peripheral side surface of a sole structure, such as sole structure 200 of FIG. 2. As shown in FIG. 4, in some embodiments each of plurality of lobes 420 (421, 422, 423, 424, 425, 426) may have an exposed distal end wall 430 (431, 432, 433, 434, 435, 436) that is configured to form a portion of a peripheral side surface of sole structure 200 (see also, e.g., sole structure 103 in FIG. 1 and assembled sole structure 200 in FIG. 3).

Plurality of lobes 420 may have similar or different sizes and shapes. As shown in FIGS. 4, 5, and 6, in some embodiments at least some of plurality of lobes 420 (421, 422, 423, 424, 425, 426) generally may have similar sizes and/or shapes. For example, as shown in FIG. 4, plurality of lobes 420 (421, 422, 423, 424, 425, 426) may have similar shapes in top plan view and in bottom plan view, e.g., generally wedge shapes that expand in a direction away from central portion 410 (see also, e.g., plurality of lobes 216 of heel chamber 210 in FIG. 2). Similarly, plurality of lobes 420 may have similar geometries in cross-section and/or similar shapes and geometries at exposed distal end walls 430. For example, as shown in FIGS. 4 and 5, in some embodiments each of plurality of lobes 420 (421, 422, 423, 424, 425, 426) may have a cross-section having a generally trapezoidal shape and an exposed distal end wall 430 (431, 432, 433, 434, 435, 436) having a generally trapezoidal shape. As shown in FIG. 5, for example, in some embodiments exposed distal end wall 435 of lobe 425 may have a width X1 (510) at upper surface 410 and a width X2 (512) at lower surface 412, where width X2 is greater than width X1 (distance X2>distance X1). As shown in FIG. 2, in some embodiments shapes of plurality of lobes 420 may be similar but vary in sizes so as to follow general contours of an assembled sole structure (see, e.g., plurality of lobes 216 and 226 of sole structure 200). It will be appreciated that plurality of lobes 420 (421, 422, 423, 424, 425, 426) may have similar or different cross-sectional and/or exposed distal end walls of other geometric shapes. For example, in some embodiments plurality of lobes 420 may have generally triangular shapes. It will be appreciated that generally triangular shapes and configuration also may provide a sole structure having a side profile that presents a visually pleasing zig-zag surface configuration.

Plurality of channels 440 located between plurality of lobes 420 likewise may have similar or different sizes and shapes. It will be appreciated that, because plurality of channels 440 (441, 442, 443, 444, 445, 446) are formed by adjacent pairs of plurality of lobes 420 (421, 422, 423, 424, 425, 426), each of plurality of channels 420 generally has a geometry at opposing sides that is complementary to the geometry of its adjacent pair of plurality of lobes 420. For example, as shown in FIG. 4, in some embodiments channel 445 located between lobe 425 and lobe 426 has a width W1 (460) at bottom surface 412 and a width W2 (462) at top surface 410, where width W2 is greater than width W1 (distance W2>distance W1). Thus, as shown in FIGS. 2 to 5, in some embodiments cross-sections of plurality of channels 440 (441, 442, 443, 444, 445, 446) defined between adjacent lobes of plurality of lobes 420 along a direction away from central portion 414 generally have trapezoidal shapes that are inverted (upside down) relative to trapezoidal shapes of congruent cross-sections of adjacent pairs of plurality of lobes 420. It will be appreciated that plurality of channels 440 (441, 442, 443, 444, 445, 446) may have cross-sections of other geometric shapes. For example, in some embodiments plurality of channels 440 (441, 442, 443, 444, 445, 446) may have cross-sections of generally triangular shapes, which also are complementary to congruous trapezoidal cross-sectional shapes of respective adjacent pairs of plurality of lobes 420. It will be appreciated that plurality of channels having cross-sections of generally triangular shapes also may provide a sole structure presenting a side profile having a visually pleasing zig-zag surface configuration.

As shown in FIG. 4, in some embodiments each of plurality of channels 441, 442, 443, 444, and 445 may have a generally truncated conical shape with an axis extending in a direction from top surface 410 of fluid-filled chamber component 400 to bottom surface 412 of fluid-filled chamber component 400. Similarly, in some embodiments channel 446 generally may form half of a truncated conical shape between lobes 421 and 426. As discussed below with respect to inter-fitted projections of midsole component 204, at least some of plurality of channels 440 (441, 442, 443, 444, 445, 446) may have a generally conical shape with a generally truncated oval or elliptical horizontal cross-section, e.g., along a lateral direction of sole structure 200.

It will be appreciated that, while the above embodiments illustrate and describe plurality of lobes 420 and plurality of channels 440 having cross-sectional walls and boundaries that correspond to continuous surfaces (i.e., plurality of lobes 420 generally have continuous smooth surfaces defining plurality of channels 440 having generally continuous smooth boundary surfaces), in some embodiments plurality of lobes 420 may have discontinuous, stepped, or non-smooth surfaces defining corresponding plurality of channels 440 that have complementary discontinuities, steps, or non-smooth surfaces. Smooth or continuous surface configurations may have advantages in some embodiments, e.g., in ease of manufacture or assembly of sole structure 200. Non-smooth, stepped, or discontinuous surface configurations may have advantages in other embodiments. Those skilled in the art will be able to select desired surface characteristics suitable for a desired embodiment or application.

At least one of plurality of exposed distal end walls 430 of plurality of lobes 420 may have a protruding portion. For example, in some embodiments at least one exposed distal end wall 430 may be faceted with a protruding portion, such as a facet edge. As shown in FIGS. 4 and 5, in some embodiments each of plurality of lobes 420 may have an exposed distal end wall 430 (431, 432, 433, 434, 435, 436) that is faceted with a protruding portion (see also protruding portions of plurality of lobes 216 and 226 in FIGS. 2 and 3, and protruding portions 106 of sole structure 103 in FIG. 1). As used in this description and in the claims, the term facet and/or faceted generally refers to surface structure including a first surface portion of the exposed distal end wall 430 that forms an edge with at least one second surface portion of the exposed distal end wall 430, where one or both of the first surface portion and the second surface portion may be straight (e.g., generally flat or planar) or curved. For purposes of brevity and simplicity, features of embodiments of one exposed distal end wall (exposed distal end wall 435 of lobe 425) having a protruding portion will be described below. Those skilled in the art readily will be able to provide similar protruding portion features for some or all of plurality of lobes 420.

In some embodiments, at least one facet of an exposed distal end wall may be arranged or oriented at an angle relative to a peripheral side surface of sole structure 200 (e.g., angled relative to vertical or relative to another portion of a peripheral side surface of sole structure 200), such that a facet edge formed between the first surface portion and the second surface portion of the exposed distal end wall protrudes further than other portions of the exposed distal end wall in an exposed direction relative to the peripheral side surface of sole structure 200. In some embodiments, a peripheral side surface of sole structure 200 may be generally vertical. In other embodiments, a peripheral side surface of sole structure 200 may be inclined relative to vertical, either inward or outward in a direction from top surface 410 of the fluid-filled chamber component 400.

As shown in FIGS. 4 to 6, for example, in some embodiments exposed distal end wall 435 may include a first facet 455 and a second facet 456, where first facet 455 has a generally trapezoidal shape and is oriented at an angle [alpha] 615 (see, FIG. 6) relative to vertical such that first facet 455 and second facet 456 form a facet edge or protruding portion 457 having three sides in the form of a generally trapezoidal arch. In some embodiments, protruding portion or facet edge 457 may occur at a smooth transition between first surface portion or facet 455 and second surface portion or facet 456 that provides a gently rounded contour that may provide increased flexibility in the protruding portion of the exposed distal end wall. As shown in FIGS. 4 to 6, in some embodiments this configuration may be made by a molding process that molds opposing first and second sheets of mold material to form top surface 410 and bottom surface 412 of fluid-filled chamber 400, respectively, where the first (top) and second (bottom) sheets are joined, e.g., by co-molding or thermal bonding, at a parting line that forms facet edge or protruding portion 457. Methods for making fluid-filled chambers and other elements of a sole structure which may be included in some aspects of some embodiments of the present application, are disclosed in Schindler et al., U.S. Pat. No. 7,707,745, issued May 4, 2010, and entitled "FOOTWEAR WITH A SOLE STRUC- TURE INCORPORATING A LOBED FLUID-FILLED CHAMBER", the entirety of which is hereby incorporated by reference.

As shown in FIG. 6, common protruding portion or facet edge 457 may form a furthest protruding portion of exposed distal end wall 435 in a direction extending away from central portion 414. As shown in FIGS. 4 to 6, each of plurality of lobes 420 generally may have a similar construction and configuration. It will be appreciated that in some embodiments this construction and configuration may provide a continuous parting line between a first sheet of mold material forming top surface 410 and a second sheet of mold material forming bottom surface 412 that follows consecutive trapezoidal shaped protruding portions or facet edges (see, e.g., protruding portion or facet edge 457) of plurality of lobes 420 of fluid-filled chamber component 400, and presents a generally zig-zag surface profile configuration. It will be appreciated that this configuration may be used to make an assembled sole structure 200 that presents a peripheral side surface having an aesthetically pleasing zig-zag surface profile configuration (see, e.g., FIGS. 1 and 3).

In some embodiments, a parting line between a first sheet of mold material forming top surface 410 and a second sheet of mold material forming bottom surface 412 alternatively may be located at a top of exposed distal end wall 430 of plurality of lobes 420. In this configuration, the parting line may be located further inward toward central area 412 of heel chamber 400 than the furthest protruding portion of each of plurality of lobes 420 (e.g., protruding facet edge 457), e.g., along a peak or highest vertical location of each of plurality of lobes 420. It will be appreciated that this configuration may allow for the parting line to be concealed when assembled with inter-fitted midsole component 204. That is, with this configuration, in some embodiments the parting line of the plurality of lobes of heel chamber 210 (400) and forefoot chamber 220 may be covered by midsole component 204.

In each of the above embodiments, a parting line between a first sheet of mold material and a second sheet of mold material may be located along plurality of channels 440 on both (opposing) sides of plurality of lobes 420. In some embodiments, the parting line may be located at or along the bottom surface 412 of fluid-filled chamber component 400. In some embodiments, the parting line may be located at an intermediate height along each lobe or along a top surface 410 of fluid-filled chamber component 400. Those skilled in the art will be able to select a location of a parting line suitable for a desired molding process and/or construction and configuration of sole structure 200 and article of footwear 100.

A configuration of sole structure 200 including a plurality of lobes (216, 226, 420) having a plurality of protruding portions may vary based on a number of factors, such as manufacturing process and desired aesthetic profile. As shown in FIGS. 3, 4, and 5, for example, actual heights of furthest protruding portions or facet edges may vary. In some embodiments, a furthest protruding height of each lobe of plurality of lobes 420 may vary in proportion with overall heights of respective plurality of lobes 420, which may vary with a contour of sole structure 200 (see, e.g., FIGS. 1 and 3). In some embodiments, a relative proportion of the height a furthest protruding portion to the height of a lobe generally may be constant. This configuration may provide consistent performance characteristics as well as a pleasing visual aesthetic profile. In some embodiments, a height of a furthest protruding portion of a lobe may be greater than 50% of a total height of the lobe. For example, as shown in FIG. 6, a height H2 (612) of common facet edge 457 of lobe 425 may be greater than 50% of a height H1 (610) of exposed distal end wall 435 of lobe 425.

It will be appreciated that this configuration, including an exposed distal end wall having a furthest protruding portion located at a height greater than 50% of a total height of the exposed distal end wall of a lobe, may facilitate controlled stable dispersion of compression forces in fluid contained within fluid-filled chamber 400, e.g., due to an impact force during running. For example, impact/compression forces created during a heel strike of a running stride, as indicated by arrows 618 in FIG. 6, may result in dispersion or channeling of compression forces outward from central portion 412 through plurality of lobes 420 to exposed distal end walls 430, causing distension of exposed and protruding portions of the exposed distal end walls (e.g., at facet edge 457 in FIG. 7) and a stabilizing dispersion of compression forces at the exposed distal end walls, as indicated by arrows 620 in FIG. 6. This configuration may reduce transfer of compression forces from fluid-filled chamber component 400 to foam material of adjacent inter-fitted midsole component 204, thereby reducing deterioration of the foam material. Accordingly, this configuration may provide desired stability characteristics and other performance characteristics in sole structure 200 and article of footwear 100.

At least one lobe of plurality of lobes 420 of fluid-filled chamber component 400 (e.g., heel chamber 210) may have a different configuration, including at least size and/or shape, than other lobes of fluid-filled chamber component 400. As shown in FIG. 4, for example, lobe 424 located in a rear lateral area of heel region 110 of sole structure 200 (generally corresponding to an initial contact area of sole structure 200 and article of footwear 100 with a ground surface during a heel strike portion of a running stride with normal pronation) may be configured with at least a greater cross-sectional width and a greater width at exposed distal end wall 434 than other lobes 420 of fluid-filled chamber component 400. As shown in FIG. 5, lobe 424 also may be configured with an angled base portion 515 at a heel strike area, e.g., base portion 515 of lobe 424 adjacent exposed distal end wall 434 may be angled up and away from the ground surface in a direction away from central portion 410 of fluid-filled chamber portion 400. The configuration of angled base portion 515, including at least size, shape, and angle of base portion 515, may vary based on a number of factors. For example a size, shape, or angle of base portion 515 may vary based on a size of the article of footwear, wear characteristics of the sole components, pronation and other characteristics of the user, and other desired performance characteristics of sole structure 200 and article of footwear 100. Those skilled in the art will be able to select a desired configuration of portion 515 including the size of angle 0, 516, which may range from approximately 0 degrees to approximately 60 degrees, suitable to provide a smooth heel strike motion and desired performance characteristics of the article of footwear.

As discussed further herein, in some embodiments an inter-fitted trapezoidal or triangular cross-sectional configuration may facilitate control of localized compression, bending, and flexibility of sole structure 200 between adjacent lobes 420, and provide improved smooth response performance and other performance characteristics of sole structure 200 and article of footwear 100. Those skilled in the art will appreciate additional geometric and/or non-geometric shapes suitable for achieving an inter-fitted configuration having desired localized compression, bending, flexing, and other performance characteristics and aesthetic profiles suitable for a particular embodiment.

Forefoot Chamber Features

Figure 7:
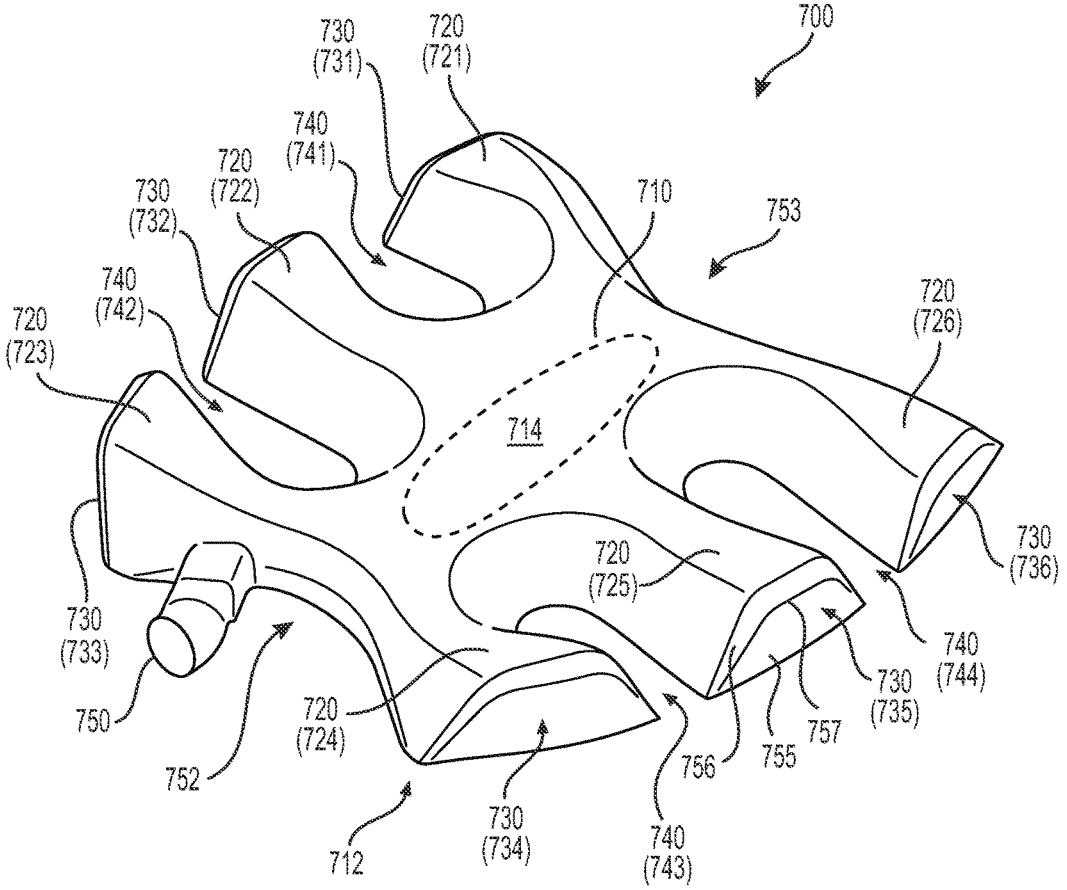
FIG. 7 is a perspective view of an embodiment of a fluid-filled chamber component located in a forefoot region of a sole structure of FIG. 2.
Figure 8:
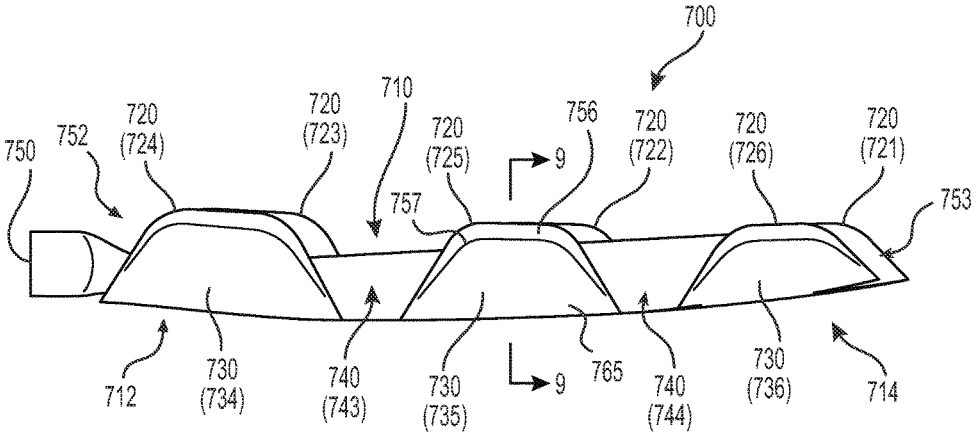
FIG. 8 is side elevation view of the fluid-filled chamber component of FIG. 7.
Figure 9:
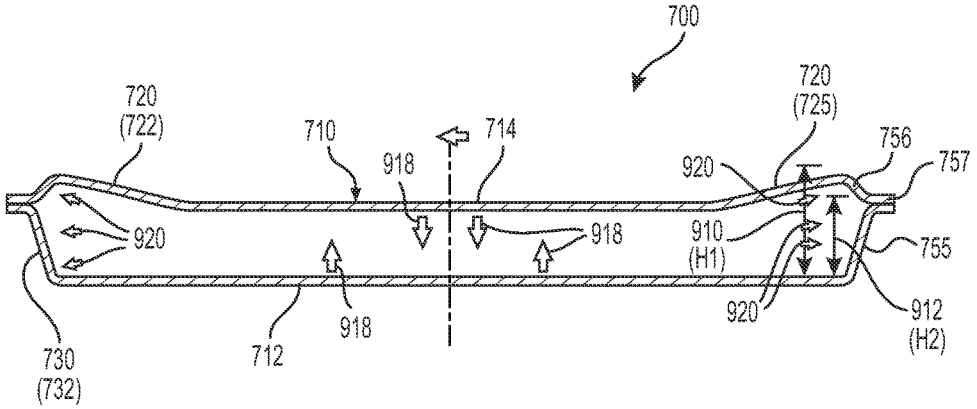
FIG. 9 is a cross-sectional view of an embodiment of the fluid-filled chamber component of FIG. 8, taken along section line 9-9 of FIG. 8.

FIGS. 7, 8, and 9 illustrate embodiments of a fluid-filled chamber component or element 700 suitable for use as forefoot chamber of a sole structure. FIG. 7 is a perspective view of fluid-filled chamber 700. FIG. 8 is a side elevation view of fluid-filled chamber component 700. And FIG. 9 is a cross-sectional view of fluid-filled chamber component 700, taken along section line 9-9 of FIG. 8. In some embodiments, fluid-filled chamber component 700 may correspond to forefoot chamber 220 of sole structure 200 in FIG. 2. Accordingly, elements of fluid-filled chamber component 700 may be indicated by reference numbers of corresponding elements of forefoot chamber 220 to describe certain features of fluid-filled chamber component 700.

Fluid-filled chamber component 700 may have a construction and configuration that is substantially similar to fluid-filled chamber component 400. It will be appreciated that fluid-filled chamber component 700 may have some differences in construction and configuration from fluid-filled chamber 400 suitable for locating fluid-filled chamber component in the forefoot region of sole structure 200 of article of footwear 100. For example, in some embodiments fluid-filled chamber component 700 may have an overall profile that is lower than an overall profile of fluid-filled chamber component 400, consistent with an overall profile of sole structure 200 (see, e.g., FIG. 3). In some embodiments, a configuration of midsole component 204 with forefoot chamber 220 (700) may be selected to provide a desired ratio of fluid to foam in specific areas under the forefoot portion.

As shown in FIG. 7, in some embodiments fluid-filled chamber component 700 (e.g., forefoot chamber 220) may include a top or upper surface 710, a bottom or lower surface 712, a central portion 714 (generally shown by a dotted line), an optional fill tube 750, and a plurality of lobes 720 (721, 722, 723, 724, 725, 726) that extend outward from central portion 714. As shown in FIG. 7, in some embodiments top surface 710 of fluid-filled chamber component 700 may be generally planar, with no raised portion in central portion 714. In some embodiments, fluid-filled chamber component 700 may include a plurality of channels 740 (741, 742, 743, 752, 753), each generally defined on three sides by central portion 714 and respective pairs of adjacent lobes of plurality of lobes 720. As shown in FIG. 7, each of plurality of channels 740 (741, 742, 743, 744, 752, 753) may be open at a side opposite central portion 714 (e.g., each channel 720 may have a side opening opposite the central portion 714 of fluid-filled chamber portion 700). As shown in FIG. 7, fluid-filled chamber component 700 may include a rear channel 752 generally formed between lobes 723 and 724, and a front channel 753 generally formed between lobes 721 and 726. It will be appreciated that this configuration may facilitate inter-fitting midsole component 204 with fluid-filled chamber component 700 in the forefoot region of sole structure 200 and article of footwear 100 (see, e.g., FIG. 2). This configuration also may enable midsole component 204 to form a portion of a peripheral side surface of sole structure 200 at side openings of plurality of channels 720 (see, e.g., FIGS. 2 and 3).

Similar to the construction of fluid-filled chamber component 400, in some embodiments plurality of lobes 720 of fluid-filled chamber component 700 may include one or more exposed distal end walls. For example, as shown in FIGS. 7 to 9, in some embodiments fluid-filled chamber component 700 may include respective exposed distal end walls 730 (731, 732, 733, 734, 735, 736). Each exposed distal end wall may include a protruding portion, with a furthest protruding portion or facet edge. For example, as shown in FIGS. 7 to 9, in some embodiments lobe 725 may include a first surface portion or facet 755 and a second surface portion or facet 756 that forms a furthest protruding portion or facet edge 757. As shown in FIG. 9, in some embodiments fluid-filled chamber component 700 may be formed by a first sheet of mold material that defines top surface 710, including second surface portion 756, a second sheet of mold material that defines bottom surface 712, including first surface portion 755, and a generally trapezoidal shaped parting line between molded top surface 710 and bottom surface 712 that defines a furthest protruding portion or facet edge 757 between first surface portion or facet 755 and second surface portion or facet 756. Similar to fluid-filled chamber component 400, the parting line between the first sheet of mold material forming the top surface 710 and the second sheet of mold material forming the bottom surface 712 may follow a line of trapezoidal-shaped furthest protruding portions (e.g., protruding portion or facet 757) around a perimeter of fluid-filled chamber component 700. Similar to fluid-filled chamber component 400, in some embodiments a height H2 (912) of furthest protruding portion or edge portion 757 may be selected to be greater than 50% of a height H1 (910) of lobe 725, as shown in FIG. 9.

Those skilled in the art readily will appreciate other similarities and differences in construction and/or configuration of fluid-filled chamber components 400 and 700 selective to the heel region and the forefoot region of sole structure 200 and article of footwear 100, consistent with this disclosure.

Midsole Component Features

Figure 10:
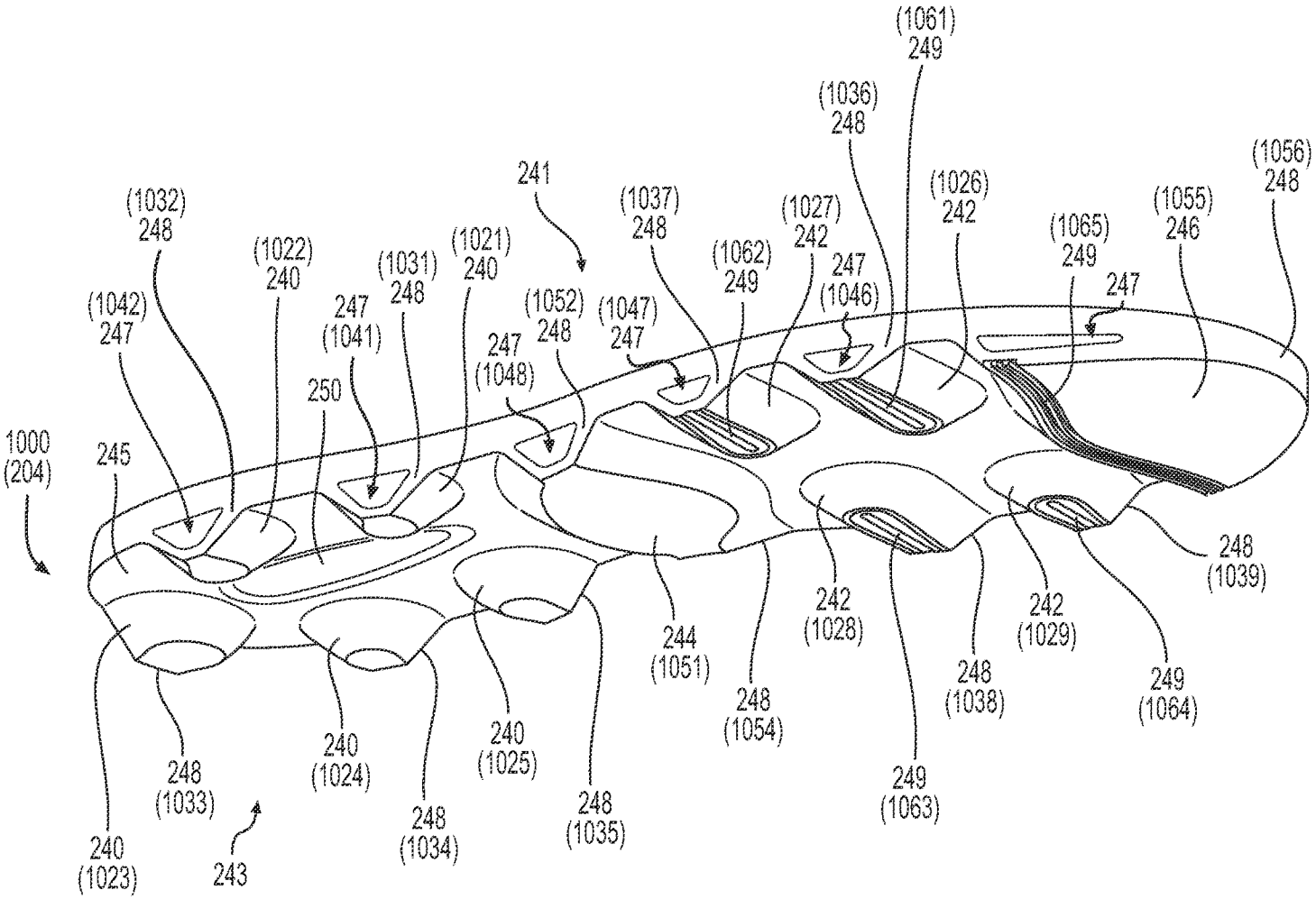
FIG. 10 is a perspective view of an embodiment of a midsole component of the sole structure of FIG. 2.

FIG. 10 illustrates an embodiment of midsole component 1000. In some embodiments, midsole component 1000 may correspond to midsole component 204 in FIG. 2. Accordingly, corresponding elements of midsole component 1000 may be indicated with corresponding reference numbers from midsole component 204 in FIG. 2 to explain certain features of midsole component 1000.

Similar to midsole component 204, midsole component 1000 generally has a top or upper surface 241, a bottom or lower surface 243, and a plurality of projections 240, 242, 244, 246 that extend downward at the lower surface of midsole component 1000. Midsole component 1000 may be formed of a foam material, such as a polyurethane foam material. The upper surface may have a smooth finish that is configured to follow contours of a foot and provide a comfortable fit. Projections 240, 242, 244, 246 generally are wider nearer to the upper surface 241 of midsole 204 than at the lower surface 243, at distal ends of the projections.

As shown in FIG. 10, midsole component 1000 may include a plurality of projections configured to inter-fit with one or more fluid-filled chamber components of a sole structure, such as fluid-filled chamber component 206 (e.g., heel chamber 210 and forefoot chamber 220) of sole structure 200 in FIG. 2. In some embodiments, midsole component 1000 may include a first plurality of projections 240 (1021, 1022, 1023, 1024, 1025) located in the heel region, and a second plurality of projections 242 (1026, 1027, 1028, 1029) located in a forefoot region. In some embodiments, midsole component 204 may include a projection 244 (1051) located in a midfoot region, and a projection 246 (1055) located in a toe region.

It will be appreciated that this configuration, including plurality of projections 1021-1029, 1051, and 1055, may enable inter-fitted assembly of midsole component 1000 with heel chamber 210 and forefoot chamber 220 of fluid-filled chamber component 206 to form assembled sole structure 200 of FIG. 2. Specifically, plurality of projections 1021, 1022, 1023, 1024, and 1025 may be inter-fitted with plurality of channels 218 of heel chamber 210, e.g., with plurality of channels 441, 442, 443, 444, and 445 of fluid-filled chamber component 400 in FIGS. 4 to 6. Similarly, plurality of projections 1026, 1027, 1028, and 1029 may be inter-fitted with plurality of channels 228 of forefoot chamber 220, e.g., with plurality of channels 741, 742, 743, and 744 of fluid-filled chamber component 700 in FIGS. 7 to 9. Similarly, projection 1051 further may be inter-fitted with channel 446 of fluid-filled chamber component 400 of FIGS. 4 to 6 and channel 752 of fluid-filled chamber component 700 in FIGS. 7 to 9, and projection 1055 may be inter-fitted with channel 753 of fluid-filled chamber component 700 in FIGS. 7 to 9.

Plurality of projections 1021-1029, 1051, and 1055 have configurations that inter-fit with configurations of plurality of channels of fluid-filled chamber component 206. As shown in FIG. 10, each of plurality of projections 1021-1029 may have a generally truncated conical configuration that extends in a direction from upper surface 241 to lower surface 243 of midsole component 1000. It will be appreciated that, because plurality of projections 1021-1029 are inter-fitting with plurality of channels 218 and 228 of heel chamber 210 and forefoot chamber 220 of fluid-filled chamber component 206, this generally truncated conical configuration also extends from a direction of a top surface to a bottom surface of heel chamber 210 and forefoot chamber 220 of fluid-filled chamber component 206. Projections 1051 and 1055 similarly may have generally truncated conical or other geometric configurations that extend from a top surface to a bottom surface of midsole component 1000.

As shown in FIGS. 2 and 10, in some embodiments, plurality of projections 1021, 1022, 1023, 1024 may be truncated at the lower surface of midsole 1000 to form a flat or planar surface suitable for securing the lower surface of midsole component 1000 to an upper surface of outer sole component 208 of sole structure 200, as shown in FIGS. 2 and 3, e.g., by adhesive or thermal bonding. Similarly, projection 1051 may be truncated at the lower surface of midsole component 1000 to form a flat or planar surface suitable for securing the lower surface of midsole component 1000 to the upper surface of outer sole component 208 of sole structure 200, as shown in FIGS. 2 and 3. Similarly, projection 1055 may be truncated at a lower surface of midsole component 1000 to form a flat or planar surface suitable securing the lower surface of midsole component 1000 to outer sole component 208 of sole structure 200, as shown in FIGS. 2 and 3.

In some embodiments, as shown in FIG. 10, plurality of projections 1021-1029 may have a generally conical configuration with a generally truncated oval cross-section (see also FIG. 2). For example, each of plurality of projections 1021-1029 may be truncated at a medial or lateral edge of midsole component 204 to form respective exposed side walls 1031-1039. Because plurality of projections 1021-1029 may be configured to be inter-fitted with plurality of channels 218 and 228 of heel chamber 210 and forefoot chamber 220 of fluid-filled chamber component 206, in some embodiments exposed side walls 10311039 may be configured to correspond with side openings of plurality of channels 218 and 228, e.g., with side openings of plurality of channels 440 (441-445) of fluid-filled chamber component 400 in FIGS. 4-6 and side openings of plurality of channels 740 (741-744) of fluid-filled chamber component 700 in FIGS. 7 to 9, to form a portion of a peripheral side surface of sole structure 200. Similarly, projection 1051 may be truncated at medial and lateral sides of midsole component 204 to form exposed side walls 1052 and 1054. In some embodiments, exposed side walls 1052 and 1054 of projection 1051 may be configured to correspond with side openings of a composite channel formed between heel chamber 210 and forefoot chamber 220 of fluid-filled chamber component 206 at the midfoot region of sole structure 200, to form respective portions of the peripheral side surface of sole structure 200. In some embodiments, exposed side walls 1031-1039, 1052, and 1054 of plurality of projections 1021-1029 and 1051 may include respective flex structures 1041-1049 (see, e.g., flex structures 1041, 1042, 1046, and 1047 shown in FIG. 10) corresponding to flex structures 247 in FIGS. 2 and 3). In some embodiments, flex structures 1041-1049 may be indentations formed in respective exposed end walls 1031-1039. In some embodiments, a shape of the flex structures may correspond with a shape of the exposed end walls. For example, in some embodiments an indentation or pattern of grooves may have a generally triangular or trapezoidal shape (see, e.g., FIGS. 1, 3, and 10). In some embodiments, the flex structures may include a plurality of flex grooves arranged in a pattern to form an overall shape of the flex structure (see, e.g., the enlarged view of flex structure 247 in FIG. 3). As discussed below with respect to FIGS. 3 and 12, flex structures 1041-1049 may help prevent bulging of midsole component 204 during bending or flexing of sole structure 200 and/or facilitate a smooth response performance characteristic of midsole component 204 and sole structure 200.

In some embodiments the plurality of protrusions of midsole component 1000 may be configured to inter-fit with and/or cooperate with features of an outer sole component, such as outer sole component 208 of FIG. 2. For example, as shown in FIGS. 2 and 10, in some embodiments plurality of protrusions 1026, 1027, 1028, 1029 may be configured to inter-fit with and cooperate with cut-out portions 235 and 237 of outer sole component 208 of FIG. 2 to facilitate localized and overall bending and flexing characteristics of sole structure 200. Protrusions 1026-1029 may be inter-fitted with plurality of channels 228 of forefoot chamber 220 such that protrusions 1026-1029 are aligned in registration with cut-out portions 235 of outer sole component 208. It will be appreciated that cut-out portions 235 thus expose protrusions 1026-1029 at the lower surface of outer sole component 208 and sole structure 200. In some embodiments, protrusions 1026-1029 may be provided with flex structures, such as flex grooves or sipes 1061, 1062, 1063, and 1064, formed in the lower surface of midsole component 204 and located at respective distal ends of plurality of projections 1026-1029. It will be appreciated that these flex grooves may cooperate with cut-out portions 235 of outer sole component 208 to provide localized and overall bending and flexing of midsole component 204 and sole structure 200. In particular, this configuration may facilitate a smooth response performance characteristic in midsole component 204 and sole structure 200.

Similarly, protrusion 1055 may be inter-fitted with forefoot chamber 220, e.g., with channel 753 of fluid-filled chamber component 700, such that a distal end of protrusion 1055 is aligned in registration with cut-out portion 237 of outer sole component 208 of FIG. 2. It will be appreciated that cut-out portion 237 thus exposes the distal end of protrusion 1055 at the lower surface of outer sole component 208 and sole structure 200. In some embodiments, the distal end of protrusion 1055 may be provided with a flex structure, such as flex grooves or sipes 249 (1065), formed in the lower surface of midsole component 204 and located at the distal end of projection 1055 adjacent the forefoot region. It will be appreciated that flex grooves 1065 may cooperate with cut-out portion 237 of outer sole component 208 to provide localized and overall bending and flexing of midsole component 204 and sole structure 200. Thus, this configuration may facilitate a smooth response performance characteristic in midsole component 204 and sole structure 200.

Outer Sole Component and Sole Structure Features

Figure 11:
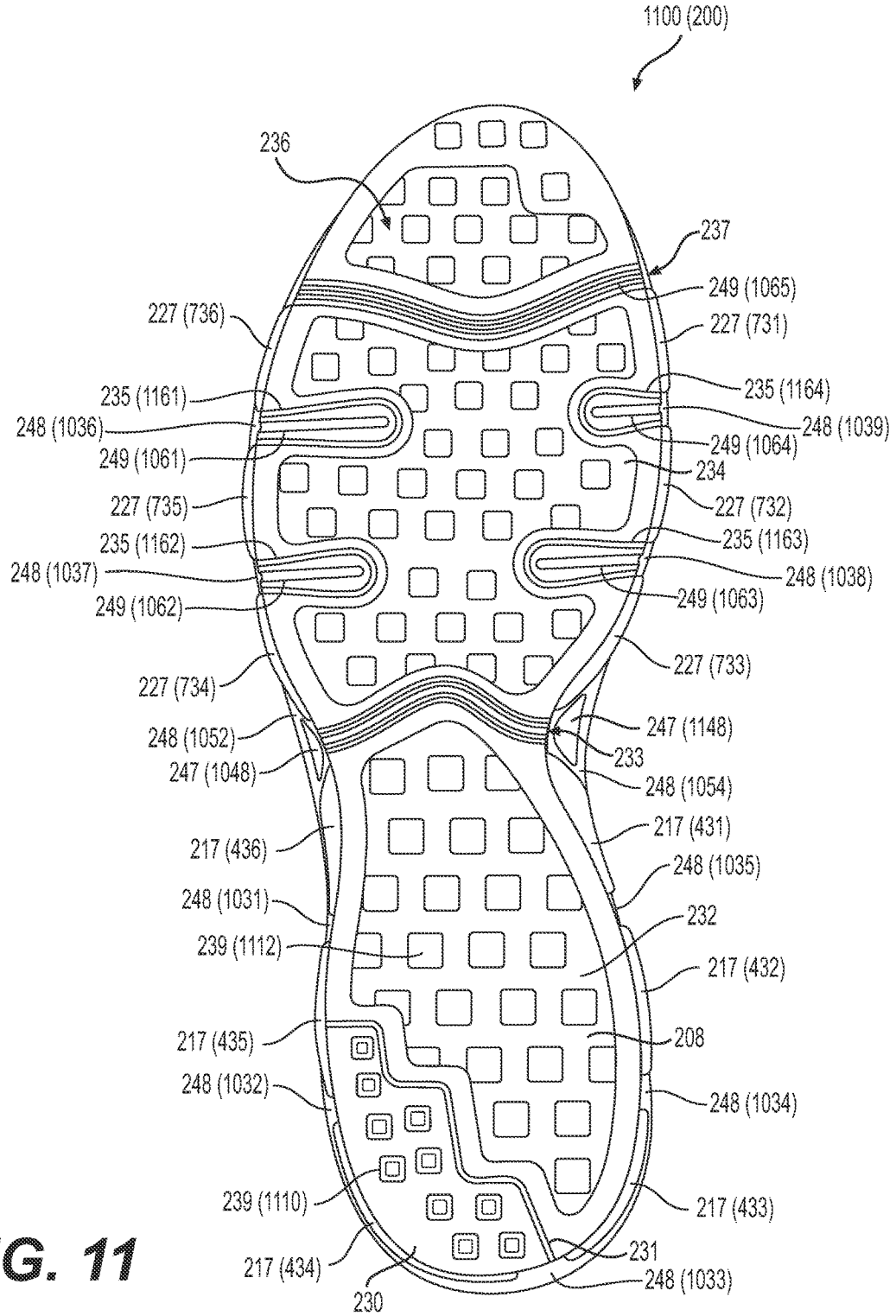
FIG. 11 is bottom plan view of an embodiment of an assembled sole structure of FIG. 3.

FIG. 11 illustrates in bottom plan view an embodiment of sole structure 1100. In some embodiments, sole structure 1100 may correspond to sole structure 200 of FIG. 2. Accordingly, elements of sole structure 1100 may be indicated with corresponding reference numbers from sole structure 200 in FIG. 2 to describe certain features of sole structure 1100.

As shown in FIG. 11, in some embodiments sole structure 1100 may include inter-fitted midsole structure 204, fluid-filled chamber component 206, and an outer sole 208.

As discussed above with reference to FIG. 2, in some embodiments outer sole component 208 may include one or more outer sole components or elements. As shown in FIG. 11, in some embodiments outer sole component 208 may include a first outer sole component or element 230 located in heel region 110 of sole structure 200, a second outer sole component or element 232 generally located in heel region 110 and midfoot region 112 of sole structure 200, a third outer sole component or element 234 generally located in midfoot region 112 and forefoot region 114 of sole structure 200, and a fourth outer sole component or element 236 generally located in toe region 116 of sole structure 200. As shown in FIG. 11, in some embodiments outer sole component or element 230 and outer sole component or element 232 may be connected at flex groove 231, with outer sole component or element 230 being generally disposed in a heel strike area of heel region 230. In some embodiments, outer sole component or element 232 and outer sole component or element 234 may be connected at flex groove 233.

Outer sole component 208 generally may be disposed below midsole component 204 and fluid-filled chamber component 206, and may be formed of an abrasion resistant material suitable for contact with a ground surface. For example, outer sole component 208 may be disposed below midsole component 204 and fluid-filled chamber component 206 in heel region 110 to protect these components from abrasive contact with a ground surface in heel region 110, e.g., during a heel strike of a running stride. Similarly, outer sole component 208 may be disposed below midsole component 204 and/or fluid-filled chamber component 206 in forefoot region 114, e.g., below the metatarsals or balls of the foot, to protect these components from abrasive contact with a ground surface, e.g., during a pivot motion. It will be appreciated that, as generally shown in FIG. 11, in bottom plan view outer sole component element 234, including cutout portions 235 and 237, generally may have a configuration, including size and shape, substantially consistent with a size and shape of forefoot chamber 220 (700).

As shown in FIG. 11, in some embodiments outer sole component 208 may include one or more outer flex structures that cooperate with one or more flex structures of inter-fitted midsole component 204 and/or fluid-filled chamber component 206 to facilitate localized compression, bending, and flexing of sole structure 200. For example, as shown in FIG. 11, outer sole component 208 may include groove portions 231, 233 in heel region 110 and midfoot region 112, respectively, to facilitate localized bending or flexing of sole structure 200 in heel region 110 and midfoot region 112. Similarly, in some embodiments outer sole component 208 may include cut-out portions 235, 237 located in forefoot region 114, to facilitate localized bending or flexing of sole structure 200 in forefoot region 114. As shown in FIG. 11, in some embodiments two pairs of cut-out portions 235 may be provided on opposing medial and lateral sides of outer sole 208, with a connecting portion of outer sole 208 disposed between the cut-out portions. In some embodiments, a cut-out portion 237 may be provided extending from a medial to lateral side of outer sole 208, thereby defining outer sole component 208 as two separate outer sole component elements. In some embodiments, outer sole 208 may include one or more traction elements 239 for providing traction with a ground surface or other external surface (e.g., a soccer ball). For example, as shown in FIGS. 2 and 11, in some embodiments a first outer sole portion (heel portion) 230 may include a plurality of recessed traction elements (e.g., indentations or wells) 1110, and each of a second outer sole portion (midfoot portion) 232, a third outer sole portion (forefoot portion) 234, and a fourth outer sole portion (toe portion) 236 may include a plurality of raised traction elements (e.g., protruding cleats) 1112.

As shown in FIG. 11, in some embodiments, outer sole component 208 may be provided with flex grooves 233 located in the midfoot region of sole structure 1100 (200) and aligned with inter-fitted structures of midsole component 204 and fluid-filled chamber component 206, e.g., generally conforming to a contour of inter-fitted channel 752 of forefoot chamber 700 (220) and protrusion 244 (1051) of midsole component 204. In some embodiments this configuration may align terminal ends of flex grooves 233 in registration with flex structures 247 (1052, 1054) of exposed side walls 244 (1048 and 1148) of midsole component 204. It will be appreciated that this configuration may provide improved flexibility, smooth response, and other performance characteristics at the midfoot region of sole structure 200.

Plurality of projections 240, 242, 244, and 246 on bottom surface 245 of midsole component 204 may be disposed at selected locations around the heel region, midfoot region, and forefoot region of midsole component 204, such that respective exposed side walls 248 (1031-1039, 1052, and 1054) collectively form a portion of a peripheral side surface of sole structure 1100 (200).

In some embodiments, as shown in FIG. 11, projecting portions of respective exposed distal end walls 217 and 227 of heel chamber 210 and forefoot chamber 220 (e.g., exposed distal end walls 431-436 of fluid-filled chamber component 400 and exposed distal end walls 731 to 736 of fluid-filled chamber component 700) may extend or project outward further than the portion of the peripheral side surface formed by adjacent exposed side walls 248 of sole structure 1100 (200). In some embodiments a portion of a peripheral side surface of sole structure 1100 (200) formed by exposed side walls 248 of midsole component 204 may be generally vertical (see, e.g., the forefoot region of sole structure 1100 (200). It will be appreciated that, however, that in some embodiments, a portion of a peripheral side surface of sole structure 1100 (200) formed by exposed side walls 248 may be inclined inward or outward relative to vertical (see, e.g., midfoot and heel regions of sole structure 1100 (200)). As shown in FIG. 11, in some embodiments exposed distal end portions 217 (430) and 227 (730) of heel chamber 210 (400) and forefoot chamber 220 (700), respectively, alternate with exposed side walls 248 (1031-1039, 1052, 1054) of midsole component 204. In some embodiments, flex grooves 247 also are visible from the sides and bottom of sole structure 1100 (200).

As shown in FIG. 11, in some embodiments plurality of cut-out portions 235 (1161-1164) align in registration with flex structures 249 (1061-1064) on midsole component 204, respectively, such that flex structures 249 (1061-1064) are exposed and visible through plurality of cut-out portions 235 (1161-1164). It will be appreciated that this configuration may facilitate localized and overall bending and flexing of sole component 1100 (200), and provide a desired smooth response characteristic and/or other performance characteristics of sole structure 1100 (200) and article of footwear 100.

Smooth Response Performance Features

Figure 12:
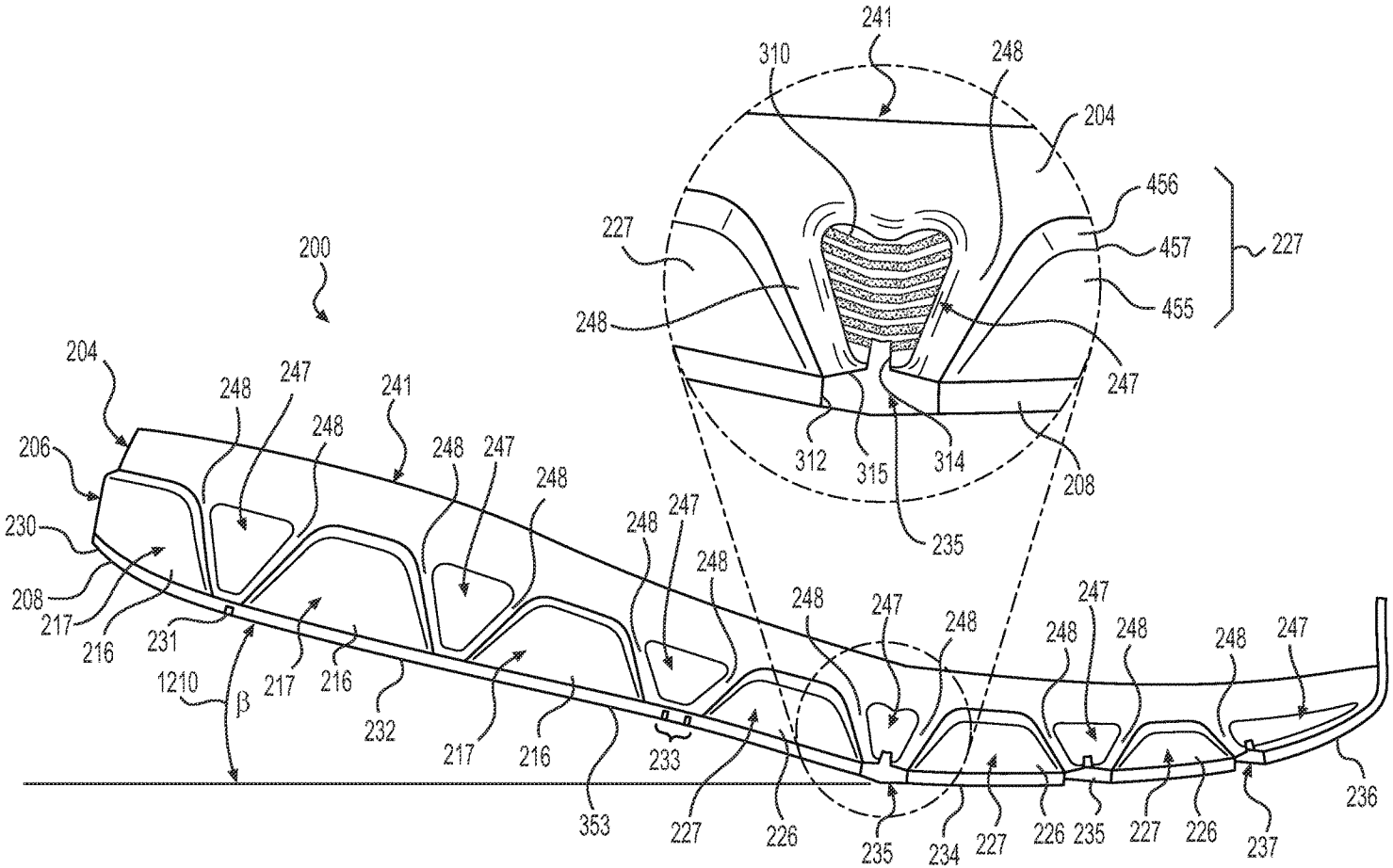
FIG. 12 is a side elevation view of an embodiment of an assembled sole structure of FIG. 3, with an enlarged partial view showing details of a portion of a midsole component inter-fitted with a fluid-filled chamber component and an outsole component in a flexed configuration.

Features of a smooth response performance will now be described with respect to an embodiment of an assembled sole structure 200 as shown in FIGS. 3 and 12. FIG. 12 is a side profile view of the assembled sole structure 200 of FIG. 3 that is bent or flexed at a location between the forefoot region and the midfoot region of sole structure 200. FIGS. 3 and 12 illustrate in enlarged view a portion of sole structure 200 at a location of bending or flexing. As shown in FIG. 12, a toe portion and forefoot region of sole structure 200 is in contact with a ground surface and the sole structure 200 is bend or flexed so that a heel region and midfoot region of sole structure 200 is elevated from the ground surface at an angle [beta] (1210).

As shown in the enlarged views in FIGS. 3 and 12, in some embodiments a projection 242 (1062) of midsole component 204 (1000) may have a generally trapezoidal configuration (pointing generally down) forming an exposed side wall 248 (1037) with a flex structure 247 (1047) having a corresponding generally trapezoidal (or triangular) shape. Exposed side wall 248 (1037) is located between two adjacent lobes 226 (734, 735) of a forefoot chamber 220 (700) of fluid-filled chamber component 206, where each of the two adjacent lobes 226 (724, 725) has a generally trapezoidal shape (pointing generally up). As shown in FIGS. 3 and 12, in some embodiments projection 242 (1062) may have an exposed distal end wall including a flex structure 249 (1062), such as a flex groove or sipe, that may be exposed through a cut-out portion 235 of outer sole component 208. As shown in FIGS. 3 and 12, flex groove or sipe 249 (1062) may be defined by side surfaces 314 that extend up through a lower portion of flex structure 247 (1047) formed in the exposed side wall 248 (1037), and may have a tapered lower surface 315 that terminates at a side surface 312 of cut-out portion 235 of outer sole component 208.

When sole structure 200 is bent or flexed at flex structure 249 (1062), projection 242 (1027) may be compressed between adjacent lobes 226 (724, 725) of forefoot chamber 220 (700), as illustrated by dashed lines around a periphery of flex structure 247 (1047) in FIG. 12. It will be appreciated that, because projection 242 (1027) has a generally trapezoidal (or triangular) cross-section, and because midsole component 204 (1000) may be made of a foam material, a portion of midsole component 242 (1000) located adjacent the top surface 222 (710) of forefoot chamber 220 (700) between adjacent lobes 226 (724, 725) may be compressed to a greater extent (i.e., a greater distance) than a portion of midsole component 204 (1000) located adjacent the bottom surface 224 (712) of forefoot chamber 220 (700). It also will be appreciated that flex groove or sipe 249 (1062) may enable midsole component 204 (1000) to flex to a more open configuration. It further will be appreciated that cut-out portion 235 may provide both outer flex structure that facilitates bending and flexing of midsole component 204 and reinforcing structure that helps prevent over stretching of flex groove or sipe 249 (1062) that may cause damage, such as tearing, of midsole component 204 at flex groove or sipe 249. It further will be appreciated that an indented configuration of flex structure 247 (1047) may enable midsole component 204 to flex at projection 242 (1027) without buckling and/or bulging in a direction laterally outwards at protrusion 242 (1027). Thus, in some embodiments this configuration may provide a smooth response performance characteristic for sole structure 200 and article of footwear 100.

Benefits explained herein with respect to different elements of sole structures 103, 200, and 1100 may be provided by the elements individually, and further may be increased even more so by combining certain of the elements together.

While various embodiments have been described, the description is intended to be exemplary, rather than limiting and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

What is claimed is:

1. A sole structure for an article of footwear, the sole structure comprising:

a fluid-filled chamber including a central portion and a plurality of lobes extending from the central portion, the plurality of lobes defining voids between adjacent ones of the plurality of lobes; and a midsole component including a plurality of projections received by respective voids of the fluid-filled chamber, wherein each of the plurality of projections includes a respective end surface that forms an outer surface of the sole structure, the end surface of at least one projection of the plurality of projections including a first portion having a concave indentation extending from a first edge to a second edge and a second portion extending around the first portion and including (i) a pair of outer edges spaced from the first edge and the second edge and abutting adjacent ones of the plurality of lobes and (ii) a pair of inner edges coincidental with the first edge and the second edge.

2. The sole structure of claim 1, wherein the plurality of lobes include end surfaces that form a portion of the outer surface of the sole structure.

3. The sole structure of claim 2, wherein the end surfaces of the plurality of lobes taper in a direction extending away from a ground-contacting surface of the sole structure and the plurality of projections taper in a direction extending toward the ground-contacting surface of the sole structure.

4. The sole structure of claim 2, wherein the end surfaces of the plurality of lobes include a first facet and a second facet that intersect at a facet edge.

5. The sole structure of claim 4, wherein the facet edge forms an outermost surface of the sole structure.

6. The sole structure of claim 1, further comprising a plurality of grooves formed into the end surface of the at least one of the plurality of projections.

7. The sole structure of claim 6, wherein the plurality of grooves are formed in the concave indentation.

8. The sole structure of claim 7, wherein the plurality of grooves include a length extending in a direction between a forefoot region of the sole structure and a heel region of the sole structure, the grooves decreasing in length in a direction extending toward a ground-contacting surface of the sole structure.

9. The sole structure of claim 1, wherein the at least one projection of the plurality of projections terminates at a ground-contacting surface of the midsole component, the ground-contacting surface including a flex groove formed in the ground-contacting surface.

10. The sole structure of claim 9, further comprising an outsole attached to the plurality of lobes and attached to the plurality of projections, the outsole including a groove that exposes the flex groove of the midsole component.

11. A sole structure for an article of footwear, the sole structure comprising:

a fluid-filled chamber including a central portion and a plurality of lobes extending from the central portion, the plurality of lobes defining voids between adjacent ones of the plurality of lobes; and a midsole component including a plurality of projections received by respective voids of the fluid-filled chamber, wherein each of the plurality of projections includes a respective end surface that forms an outer surface of the sole structure, the end surface of at least one projection of the plurality of projections including a first portion having a plurality of grooves extending from a first edge to a second edge and a second portion extending around the first portion and including (i) a pair of outer edges spaced from the first edge and the second edge and abutting adjacent ones of the plurality of lobes and (ii) a pair of inner edges coincidental with the first edge and the second edge.

12. The sole structure of claim 11, wherein the plurality of lobes include end surfaces that form a portion of the outer surface of the sole structure.

13. The sole structure of claim 12, wherein the end surfaces of the plurality of lobes taper in a direction extending away from a ground-contacting surface of the sole structure and the plurality of projections taper in a direction extending toward the ground-contacting surface of the sole structure.

14. The sole structure of claim 12, wherein the end surfaces of the plurality of lobes include a first facet and a second facet that intersect at a facet edge.

15. The sole structure of claim 14, wherein the facet edge forms an outermost surface of the sole structure.

16. The sole structure of claim 11, wherein the end surface of the at least one projection includes a concave indentation.

17. The sole structure of claim 16, wherein the plurality of grooves are formed in the concave indentation.

18. The sole structure of claim 11, wherein the plurality of grooves decrease in length in a direction extending toward a ground-contacting surface of the sole structure.

19. The sole structure of claim 11, wherein the at least one projection terminates at a ground-contacting surface of the midsole component, the ground-contacting surface including a flex groove formed in the ground-contacting surface.

20. The sole structure of claim 19, further comprising an outsole attached to the plurality of lobes and attached to the plurality of projections, the outsole including a groove that exposes the flex groove of the midsole component.

* * * * *